US012660978B2

(12) United States Patent
Kim et al.

(10) Patent No.: US 12,660,978 B2
(45) Date of Patent: Jun. 23, 2026

(54) DISHWASHER AND CONTROL METHOD THEREOF

(71) Applicant: LG Electronics Inc., Seoul (KR)

(72) Inventors: Ilhwan Kim, Seoul (KR); Seunghun Kim, Seoul (KR); Sangheon Yoon, Seoul (KR)

(73) Assignee: LG Electronics Inc., Seoul (KR)

( * ) Notice: Subject to any disclaimer, the term of this patent is extended or adjusted under 35 U.S.C. 154(b) by 310 days.

(21) Appl. No.: 18/266,730

(22) PCT Filed: Dec. 6, 2021

(86) PCT No.: PCT/KR2021/018380
§ 371 (c)(1),
(2) Date: Jun. 12, 2023

(87) PCT Pub. No.: WO2022/124738
PCT Pub. Date: Jun. 16, 2022

(65) Prior Publication Data

US 2024/0041294 A1 Feb. 8, 2024

(30) Foreign Application Priority Data

Dec. 11, 2020 (KR) ..... 10-2020-0173489
Apr. 26, 2021 (KR) ..... 10-2021-0053786

(51) Int. Cl.
*A47L 15/00* (2006.01)
*A47L 15/42* (2006.01)
*A47L 15/48* (2006.01)

(52) U.S. Cl.
CPC ..... *A47L 15/0049* (2013.01); *A47L 15/4287* (2013.01); *A47L 15/486* (2013.01); *A47L 15/488* (2013.01); *A47L 2401/18* (2013.01); *A47L 2501/11* (2013.01);
(Continued)

(58) Field of Classification Search
None
See application file for complete search history.

(56) References Cited

U.S. PATENT DOCUMENTS

2010/0101613 A1* 4/2010 Jerg ..... A47L 15/481 34/498
2011/0048465 A1* 3/2011 Jerg ..... A47L 15/0023 134/25.2
(Continued)

FOREIGN PATENT DOCUMENTS

CN 110840362 A * 2/2020 ..... A47L 15/4285
CN 111956152 A * 11/2020 ..... A47L 15/4293
(Continued)

*Primary Examiner* — Omair Chaudhri
(74) *Attorney, Agent, or Firm* — Fish & Richardson P.C.

(57) ABSTRACT

The present disclosure relates to a method of controlling a dishwasher. The method of controlling a dishwasher of the present disclosure includes steps of: detecting a temperature of air supplied to a tub through a heating duct by a temperature sensor; operating a supply fan which supplies outdoor air to the heating duct; operating a heater disposed in the heating duct; determining whether the supply fan and the heater are normally operating; and determining that the supply fan and the heater are normally operating, when a temperature change detected by the temperature sensor is within a first set range.

9 Claims, 20 Drawing Sheets

(52) U.S. Cl.
CPC ..... *A47L 2501/12* (2013.01); *A47L 2501/14* (2013.01); *A47L 2501/26* (2013.01); *A47L 2501/32* (2013.01)

(56) References Cited

U.S. PATENT DOCUMENTS

| | | | | |
|---|---|---|---|---|
| 2013/0048626 | A1* | 2/2013 | Seo | F22B 1/284 392/394 |
| 2017/0188778 | A1* | 7/2017 | Kim | A47L 15/0028 |
| 2018/0000311 | A1* | 1/2018 | Ryu | A47L 15/22 |
| 2020/0100644 | A1* | 4/2020 | Kopera | A47L 15/488 |

FOREIGN PATENT DOCUMENTS

| | | | | | |
|---|---|---|---|---|---|
| JP | H07-005550 | | | 1/1995 | |
| JP | H07-039507 | | | 2/1995 | |
| JP | H11-151192 | | | 6/1999 | |
| JP | 2001-246333 | | | 9/2001 | |
| JP | 2009089766 | A | * | 4/2009 | A47L 15/0084 |
| JP | 2011-217812 | | | 11/2011 | |
| JP | 2011217812 | A | * | 11/2011 | |
| KR | 20100082661 | A | * | 7/2010 | A47L 15/46 |

* cited by examiner

DISHWASHER AND CONTROL METHOD THEREOF

CROSS-REFERENCE TO RELATED APPLICATIONS

This application is a National Stage application under 35 U.S.C. § 371 of International Application No. PCT/KR2021/018380, filed on Dec. 6, 2021, which claims the benefit of Korean Patent Application No. 10-2020-0173489, filed on Dec. 11, 2020, and Korean Patent Application No. 10-2021-0053786, filed on Apr. 26, 2021. The disclosures of the prior applications are incorporated by reference in their entirety.

TECHNICAL FIELD

The present disclosure relates to a dishwasher, and more particularly, to a dishwasher having an exhaust device for drying a tub and a supply device.

BACKGROUND ART

A dishwasher cleans, rinses, and dries dishes to provide convenience to a user by treating contaminants on dishes and drying the dishes.

The process of drying the dishes may be performed by heating water stored in the dishwasher and supplying high-temperature water vapor to the dishes.

Patent Publication KR-2017-0016181 discloses that washing water stored in a sump or washing pump is heated, and heated water vapor is supplied to a space inside a tub to increase the temperature of dishes to dry dishes.

However, such a drying cycle requires a separate process in which the door of the dishwasher must be kept open after the dishwasher is operated.

When the air supplied to the tub is heated and supplied, the inside of the tub can be quickly dried.

Patent Publication KR2016-0146091 discloses a structure in which air is supplied into the tub through a supply fan and the air supplied through a heater is heated.

However, when the supply fan or heater fails, the drying function may deteriorate, and if the failure of the supply fan or heater or the failure of a specific component can be quickly identified, immediate follow-up treatment may be possible.

DISCLOSURE

Technical Problem

The present disclosure has been made in view of the above problems, and provides a dishwasher that improves drying performance by rapidly discharging wet vapor existing in a tub to the outside.

The present disclosure further provides a dishwasher capable of rapidly drying the inside of a tub while adjusting the temperature of air discharged to the outside. That is, it is to provide a dishwasher capable of solving the safety problem by maintaining the temperature of the discharged air below a set temperature, and quickly discharging wet vapor inside the tub by an air mixing or a single discharge according to the discharged temperature.

The present disclosure further provides a dishwasher capable of rapidly drying the inside of the tub by supplying dry outdoor air to the tub. In addition, it is to provide a dishwasher that improves drying performance by heating air supplied into the tub and supplying high-temperature, dry air into the tub.

The present disclosure further provides a control method for a dishwasher capable of quickly determining whether a component is failing in a structure in which outdoor air is heated and supplied. In addition, it is to provide a dishwasher and a control method thereof capable of accurately determining a component which is determined failure among a plurality of components for heating outdoor air.

The tasks of the present disclosure are not limited to the tasks mentioned above, and other tasks not mentioned will be clearly understood by those skilled in the art from the following description.

Technical Solution

In an aspect, there is provided a method of controlling a dishwasher, the method including steps of: detecting a temperature of air supplied to a tub through a heating duct by a temperature sensor; operating a supply fan which supplies outdoor air to the heating duct; operating a heater disposed in the heating duct; determining whether the supply fan and the heater are normally operating; and determining that the supply fan and the heater are normally operating, when a temperature change detected by the temperature sensor is within a first set range, thereby accurately determining whether the heater or supply fan is operating normally.

The method further includes a step of notifying an error code through an output unit, when the temperature change detected by the temperature sensor deviates from the first set range, thereby determining the failure of the heater or supply fan.

The method further includes a step of stopping operation of the supply fan and the heater after a drying time, when it is determined that the supply fan and the heater are normally operating, so that during normal operation, outdoor air can be heated and supplied to the inside of the tub. This can minimize the time required for the drying cycle.

The method further includes a step of determining a failure of each of the supply fan and the heater through the temperature sensor, when the temperature change detected by the temperature sensor deviates from the first set range, thereby determining whether there is a failure of a specific configuration of the heater and the supply fan.

The failure determination of each of the supply fan and the heater is determined by whether the temperature change detected by the temperature sensor is within a second set range, wherein the second set range forms a value smaller than the first set range, thereby determining whether there is a failure of each of the supply fan and the heater.

When the temperature change detected by the temperature sensor satisfies the second set range, the failure of the supply fan is determined, so that it is possible to check the failure of the supply fan.

When the temperature change detected by the temperature sensor deviates from the second set range, the failure of the heater is determined, so that it is possible to check the failure of the heater.

The failure determination of each of the supply fan and the heater is determined based on a change rate in resistance of the temperature sensor, so that it is possible to determine the failure of each of the supply fan and the heater.

The failure of the supply fan is determined, when the change rate of the resistance value of the temperature sensor is smaller than a set resistance value.

The step of determining a failure of each of the supply fan and the heater is performed, after a set time from the step of determining whether the supply fan and the heater are normally operating, so that it is possible to perform precise failure determination of each of the supply fan and the heater.

The method further includes steps of: outputting the failure error through an output unit, when failure of one of the supply fan and the heater is determined; and stopping operation of the heater and the supply fan, so that inefficient drying can be stopped.

The method further includes steps of: stopping the operation of the heater and the supply fan when the failure of one of the supply fan and the heater is determined; and heating washing water stored in a sump disposed below a tub and supplying steam to the tub, so that drying may be performed by a method excluding a method of supplying outdoor air.

In another aspect, there is provided a dishwasher including: a tub; a supply fan which supplies outdoor air to the tub; a supply fan housing which forms a space in which the supply fan is disposed; a heating duct which is disposed in one side of the supply fan housing and guides flowing air; a heater which is disposed inside the heating duct and heats flowing air; a supply duct which is connected to the heating duct and supplies air flowing from the heating duct to the tub; a temperature sensor which detects a temperature of the air flowing from the heating duct; and a controller which detects whether the supply fan or the heater is failed based on a temperature change detected by the temperature sensor, thereby determining the failure of the supply fan and the heater.

The heater uses a sheath heater type having a coil shape, thereby improving the accuracy of the temperature sensor.

The heating duct forms a flow path in a direction in which a center of coil of the heater extends, thereby improving the accuracy of the temperature sensor.

The temperature sensor is disposed in a discharge end of the heating duct, thereby improving the accuracy of the temperature of the air discharged from the heating duct.

Details of other embodiments are included in the detailed description and drawings.

Advantageous Effects

According to the dishwasher of the present disclosure, one or more of the following effects are provided.

First, there is an advantage in that the inside of the tub can be rapidly dried by discharging the air inside the tub to the outside through an exhaust device to discharge the humid air of the tub to the outside.

Second, it has the advantage of minimizing user's inconvenience caused by the air discharged to the outside of the tub, and shortening the time required for a drying cycle, by adjusting a first valve and a second valve such that the temperature of the air discharged from the dishwasher is formed below a set level. That is, there is an advantage in that the entire operation time of the dishwasher can be reduced.

Third, there is an advantage in that drying performance can be improved by supplying dry air to the inside of the tub, by including a supply device for supplying air from the outside. In addition, it is possible to supply hot and dry air to the tub by disposing a heater in the supply device.

Fourth, by using a temperature sensor, it is possible to quickly determine whether a supply fan for supplying outdoor air to the tub and a heater for heating outdoor air are failing.

Fifth, a coil-shaped sheath heater is used as a heater for heating the outdoor air, a heating duct forms a flow path for guiding air in the direction in which the center of a coil of the heater extends, and a temperature sensor is disposed in a distal end of the heating duct, thereby improving the accuracy of the temperature sensor. This has the advantage of being able to accurately determine whether the heater or the supply fan is failing.

The effects of the present disclosure are not limited to the effects mentioned above, and other effects not mentioned can be clearly understood by those skilled in the art from the description of the claims.

MODE FOR INVENTION

Figure 1:
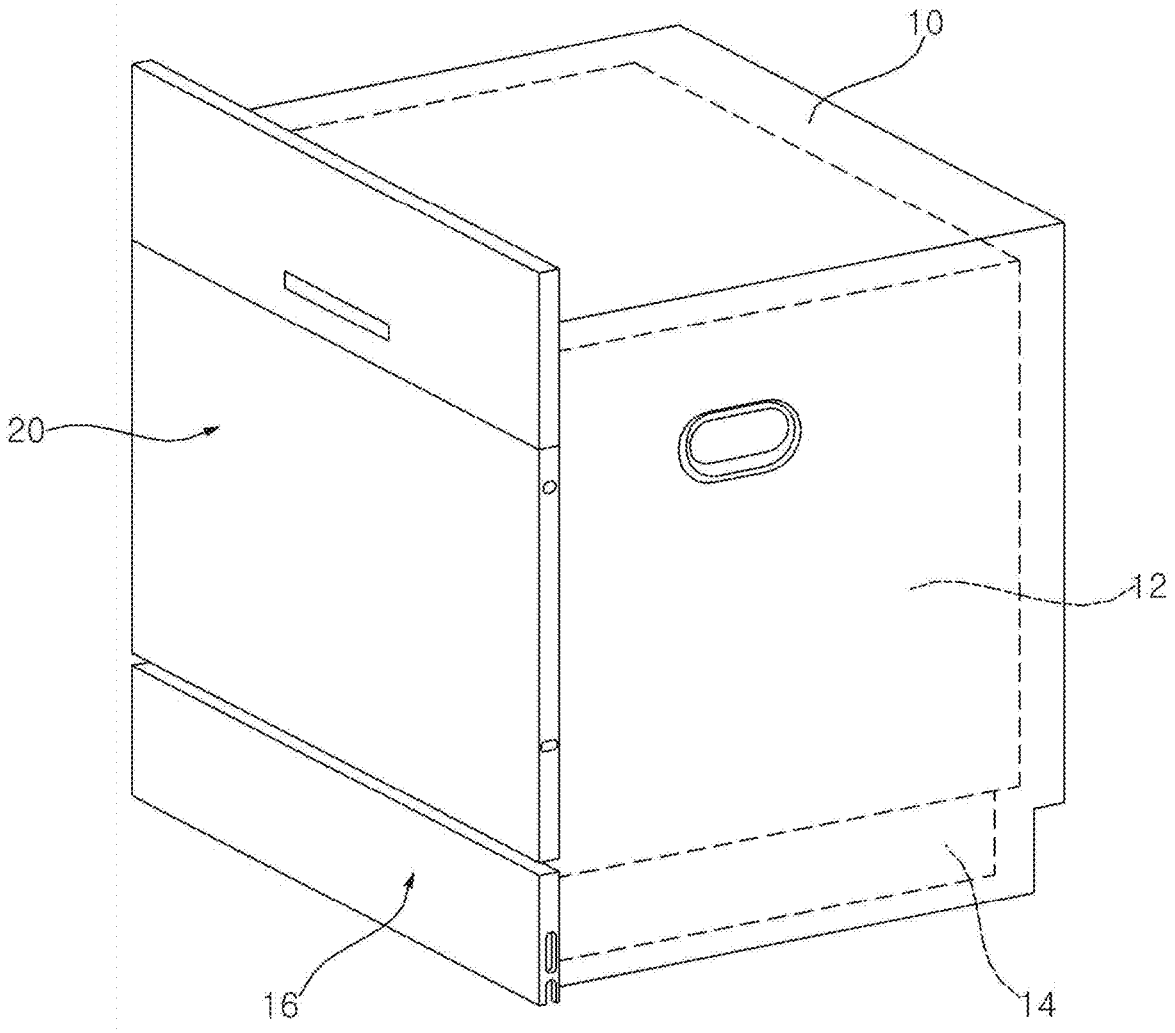
FIG. 1 is a perspective view of a dishwasher according to an embodiment of the present disclosure.

Advantages and features of the present disclosure and methods of achieving them will become apparent with reference to the embodiments described below in detail in conjunction with the accompanying drawings. However, the present disclosure is not limited to the embodiments disclosed below, but may be implemented in various different forms, and these embodiments are provided only to allow the disclosure of the present disclosure to be complete, and to completely inform those of ordinary skill in the art to which the present disclosure belongs, the scope of the invention, and the present disclosure is only defined by the scope of the claims. Like reference numerals refer to like elements throughout.

Hereinafter, the present disclosure will be described with reference to drawings for explaining a dishwasher according to embodiments of the present disclosure.

Figure 2:
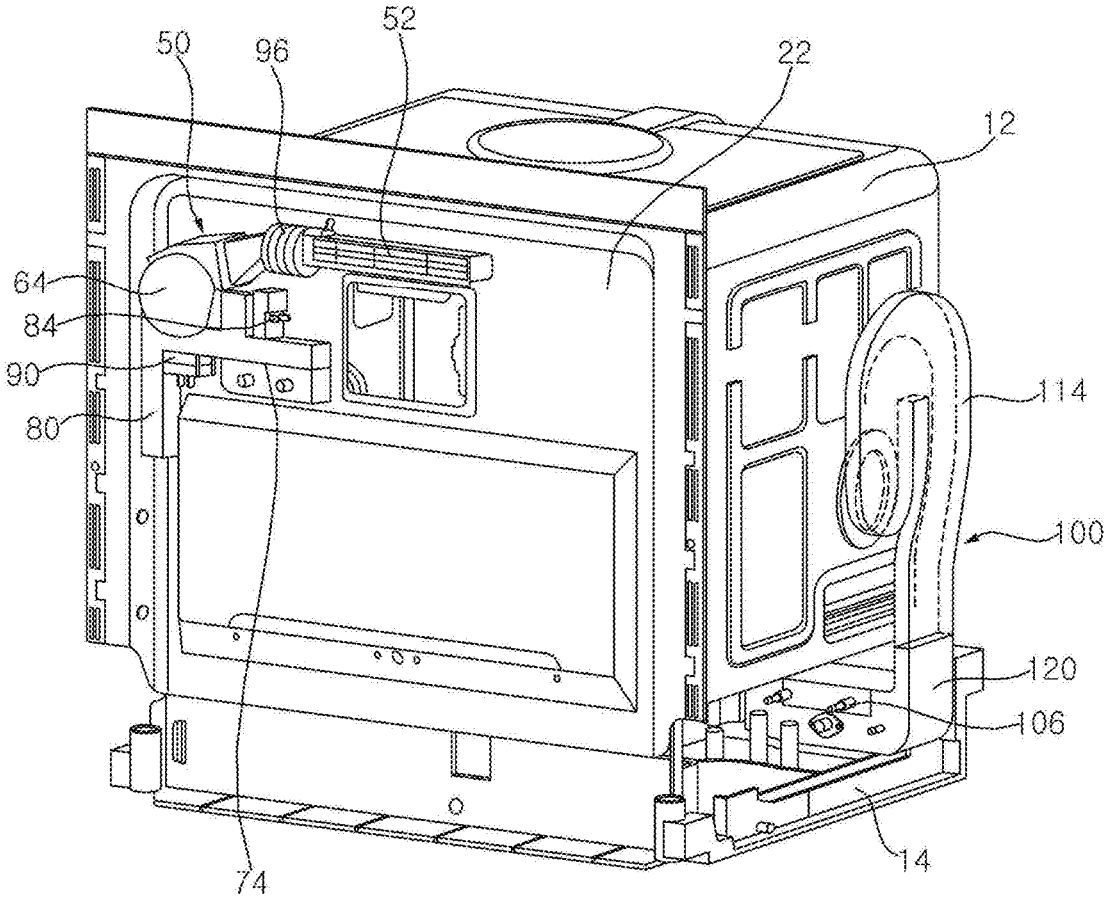
FIG. 2 is a perspective view of a tub, and an exhaust device and a supply device mounted in the tub according to an embodiment of the present disclosure.

Referring to FIGS. 1 and 2, a dishwasher 1 of the present disclosure includes a case 10 having an outer shape and an open front surface, a tub 12 that is disposed inside the case 10 and forms a washing space (not shown) in which dishes are disposed, a door 20 that opens and closes the front surface of the tub 12, a base 14 that is disposed below the tub 12 and forms a space, between the tub 12 and the base 14, in which a washing water processing component is disposed, and a lower cover 16 disposed to cover the front surface of the base 14.

A washing space is formed inside the tub 12. A rack (not shown) for receiving dishes and a plurality of spray nozzles (not shown) for spraying washing water into the inner space of the tub 12 may be disposed inside the tub 12.

Referring to FIG. 2, the dishwasher 1 includes an exhaust device 50 for discharging air inside the tub 12 to the outside, and a supply device 100 for supplying outdoor air to the washing space inside the tub 12. The exhaust device 50 may be disposed in the door 20 to discharge the air inside the tub 12 to the outside, or to mix the air inside the tub 12 with outdoor air and discharge the mixture to the outside. The supply device 100 may be disposed in the lateral side and the lower side of the tub 12, and may heat outdoor air and supply it to the tub 12.

Figure 3:
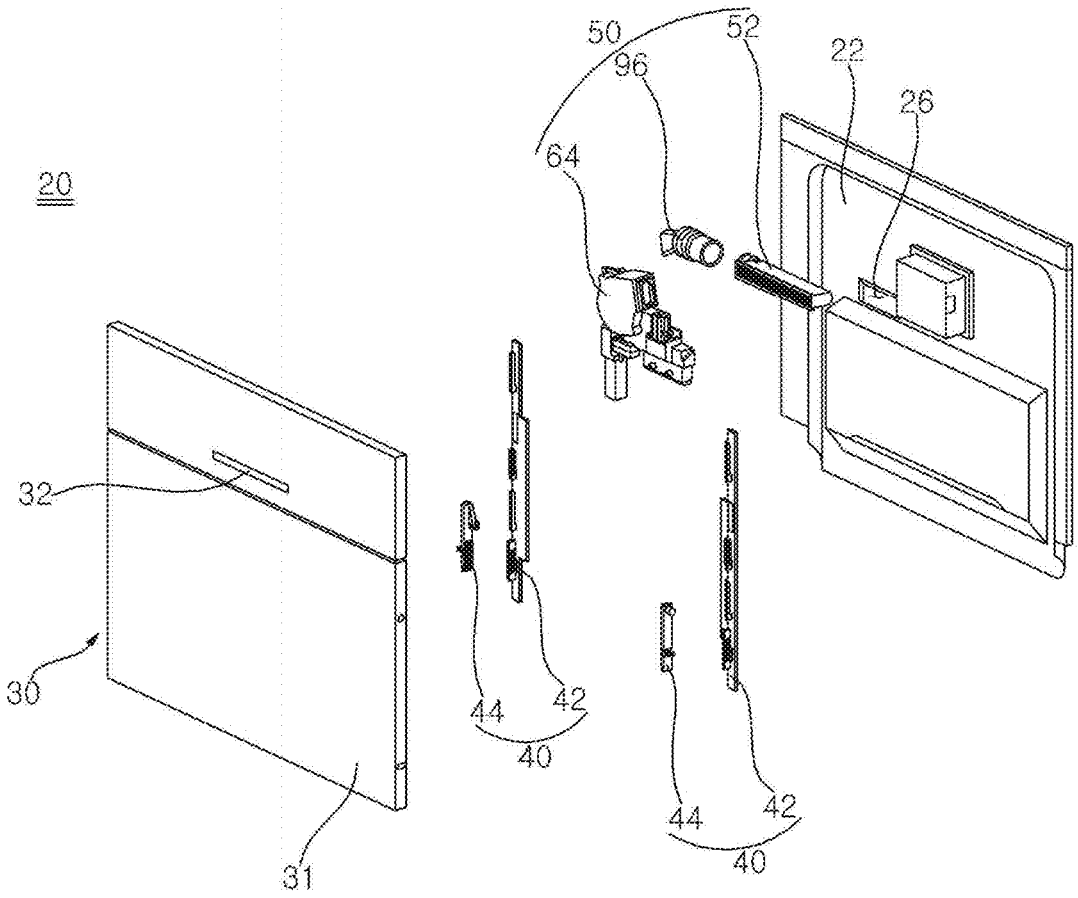
FIG. 3 is an exploded perspective view of a door and an exhaust device disposed inside the door according to an embodiment of the present disclosure.

Referring to FIG. 3, the door 20 includes an inner door 22 that opens and closes the open front surface of the tub 12, an outer door 30 disposed to be movable in the up-down direction in front of the inner door 22, and a moving member 40 that is fixed to the inner door 22 and moves the outer door 30 in the up-down direction.

The inner door 22 opens and closes the open front surface of the tub 12. A dispenser 24 for temporarily storing detergent and loading detergent into the tub 12 is disposed in the inner door 22. An inner hole 26 communicating the washing space of the tub 12 and the exhaust device 40 is formed in the inner door 22. The inner hole 26 is disposed in a position lower than an exhaust hole 32 formed in the outer door 30 described below.

The outer door 30 is disposed in the inner door 22 so as to be movable in the up-down direction. It may be moved in the up-down direction of the inner door 22 by the moving member 40 disposed inside the door 20. The moving member 40 may include a guider 42 that is fixed to the inner door 22 and restricts the movement of the outer door 30, and a button 44 that is mounted in the outer door 30 and disposed to engage with or be spaced apart from the guider 42.

In the outer door 30, the exhaust hole 32 through which air flowing through the exhaust device 40 is discharged to the outside is formed in a front wall 31. The exhaust hole 32 is disposed in a higher position than the inner hole 26 formed in the inner door 22. That is, even in a state in which the outer door 30 is disposed downward as much as possible with respect to the inner door 22, the exhaust hole 32 is disposed in a higher position than the inner hole 26.

The exhaust device 50 is disposed in a space between the inner door 22 and the outer door 30. A part of the exhaust device 50 may be mounted in the inner door 22 and the other part may be mounted in the outer door 30. When the outer door 30 and the inner door 22 are coupled, a space in which the exhaust device 50 is disposed is formed inside. In addition, when the inner door 22 and the outer door 30 are coupled, a hole communicating with the outside may be formed in the lower side.

The exhaust device 50 is disposed in a space formed inside the door 20. The exhaust device 50 may discharge the air inside the tub 12 to the outside or mix the air inside the tub 12 with outdoor air and discharge the mixed air to the outside.

The exhaust device 50 may mix the air inside the tub 12 with outdoor air and discharge the mixed air based on the temperature of the discharged air, or may discharge only the air inside the tub 12 to the outside.

Figure 4:
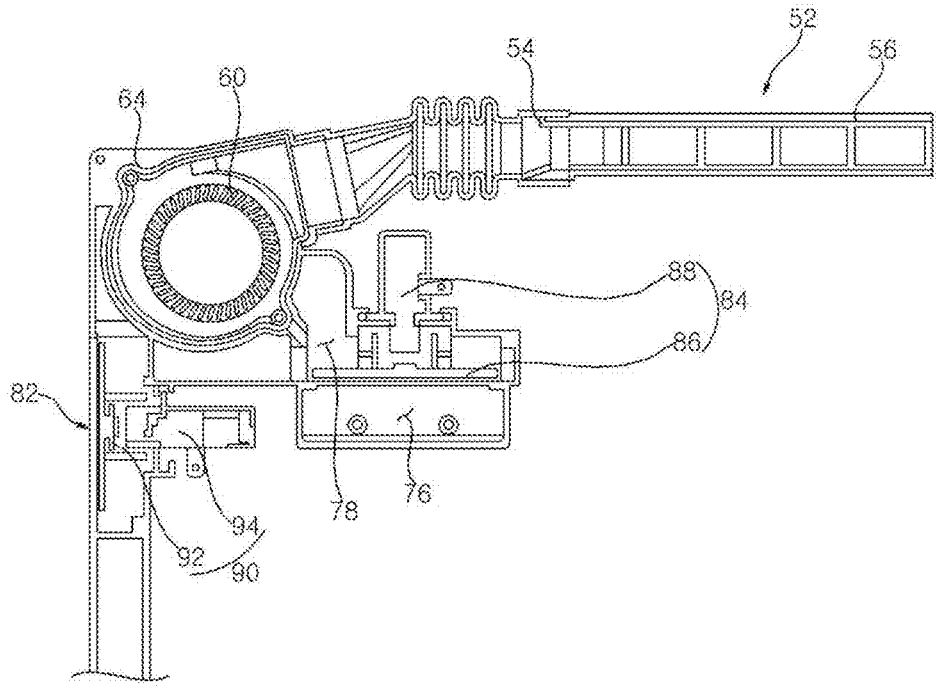
FIG. 4 is a diagram for explaining an exhaust device according to an embodiment of the present disclosure.

Referring to FIGS. 3 and 4, the exhaust device 50 includes an exhaust duct 52 for discharging air through the exhaust hole 32 of the door 20, an exhaust fan 60 for flowing air to the exhaust duct 52, an exhaust fan housing 64 forming a space in which the exhaust fan 60 is disposed, an indoor air inlet duct 74 for sending air from the tub 12 to the exhaust fan housing 64, an outdoor air inlet duct 80 for sending outdoor air to the exhaust fan housing 64, a first valve 84 for opening and closing the indoor air inlet duct 74, and a second valve 90 that opens and closes the outdoor air inlet duct 80.

The exhaust device 50 may further include a variable duct 96 having a structure whose length is variable according to the disposition change of the outer door 30.

The indoor air inlet duct 74 connects the inner hole 26 formed in the inner door 22 and the exhaust fan housing 64.

Referring to FIG. 4, in the inside of the indoor air inlet duct 74, an indoor air inlet chamber 76 forming a space forward from a portion where the inner hole 26 is formed, and a connection chamber 78 that extends upward from the indoor air inlet chamber 76 and connects the indoor air inlet chamber 76 and the exhaust fan housing 64 may be formed.

Referring to FIG. 4, the first valve 84 moves in the up-down direction from the connection chamber 78 and may open and close between the connection chamber 78 and the indoor air inlet chamber 76.

The first valve 84 may include a first opening/closing plate 86 that moves in the up-down direction from the connection chamber 78 and opens and closes the indoor air inlet duct 74, and a first actuator 88 that moves the first opening/closing plate 86.

Referring to FIG. 4, an outdoor air inlet 82 communicating with a space formed inside the door 20 is formed in one side of the outdoor air inlet duct 80. The second valve 90 may open and close the outdoor air inlet 82 formed in the outdoor air inlet duct 80.

The second valve 90 may open and close the outdoor air inlet duct 80 to adjust the amount of air discharged from the tub 12. That is, the air discharged through the exhaust duct 52 is an air flowing from the indoor air inlet duct 74 and the outdoor air inlet duct 80. Since the exhaust duct 52 maintains a constant size, the amount of air flow may be constant, at the time when both the indoor air inlet duct 74 and the outdoor air inlet duct 80 are open, and at the time when only the indoor air inlet duct 74 is open. Therefore, when both the indoor air inlet duct 74 and the outdoor air inlet duct 80 are opened, the outdoor air and the air in the tub may be mixed and flowed. Thus, the amount of air discharged from the inside of the tub 12 may be relatively small. Since the amount of humid air inside the tub 12 discharged to the outside is reduced, drying performance inside the tub 12 may be relatively decreased. Meanwhile, when only the indoor air inlet duct 74 is opened, only the air inside the tub 12 is discharged through the exhaust duct 52, so that the amount of humid air inside the tub 12 discharged to the outside relatively increases. Therefore, when only the indoor air inlet duct 74 is opened, the drying performance can be relatively increased.

Referring to FIG. 4, the second valve 90 moves in the left-right direction inside the outdoor air inlet duct 80, and may open and close the outdoor air inlet 82. The second valve 90 may include a second opening/closing plate 92 that moves in the left-right direction in the outdoor air inlet duct 80 and opens and closes the outdoor air inlet 82, and a second actuator 94 that moves the second opening/closing plate 92.

Figure 5:
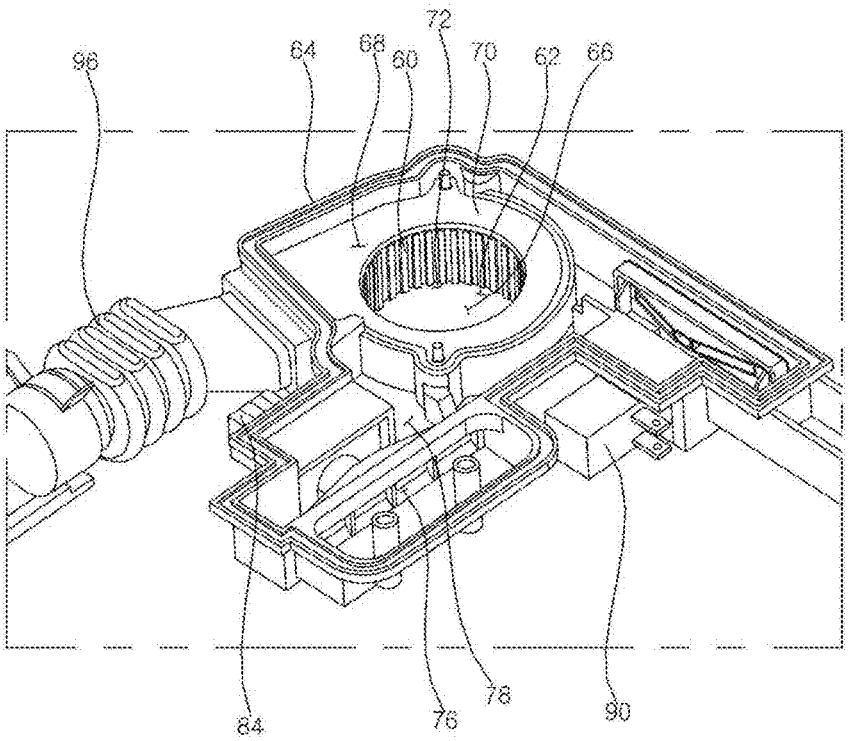
FIG. 5 is a cross-sectional perspective view of an exhaust device according to an embodiment of the present disclosure.

Referring to FIG. 5, the exhaust fan 60 may use a sirocco fan that sucks in air in a rotational center direction, and discharges air in a radial direction of the exhaust fan 60. Accordingly, the exhaust fan 60 forms a fan inlet 62 in one direction in which a virtual axis of rotation is formed.

In the inside of the exhaust fan housing 64, a discharge chamber 66 in which the exhaust fan 60 is disposed, and a suction chamber 68 communicating with the outdoor air inlet duct 80 or the indoor air inlet duct 74 are formed. The discharge chamber 66 and the suction chamber 68 may be separated by a partition wall 70 disposed inside the exhaust fan housing 64.

A communication hole 72 communicating the suction chamber 68 and the discharge chamber 66 may be formed in the partition wall 70 at a portion where the fan inlet 62 is formed.

Referring to FIG. 3, the exhaust duct 52 is disposed in a portion of the outer door 30 where the exhaust hole 32 is formed. The exhaust duct 52 forms an exhaust flow path that is elongated in the left-right direction where the exhaust hole 32 is formed. The exhaust duct 52 forms an opening in the front where the exhaust hole 32 is formed.

The exhaust duct 52 includes an inlet end 54 that is connected to the variable duct 96 and forms an exhaust duct inlet (not shown), and an exhaust duct body 56 that is connected to the inlet end 54 in one side, forms an exhaust duct outlet 58 in the front surface, and forms an exhaust flow path inwardly.

In the front surface of the exhaust duct body 56, an exhaust duct outlet 58 is formed. The exhaust duct outlet 58 is formed in a direction perpendicular to the exhaust duct inlet formed in the inlet end 54. The area of the exhaust duct outlet 58 is larger than the area of the exhaust duct inlet formed in the inlet end 54. Accordingly, the flow rate of the air discharged through the exhaust duct outlet 58 may be rapidly reduced.

The exhaust duct 52 may form an inclined surface that is lowered downward as it progresses toward the rear from the exhaust duct outlet 58.

The variable duct 96 may have a corrugated pipe shape having a variable length. Therefore, even if the outer door 30 moves upward of the inner door 22, the exhaust device 50 and the exhaust duct 52 may be connected. The variable duct 96 may be formed of a rubber material whose corrugated pipe structure can be easily changed.

A first temperature sensor 210 for detecting the temperature of the air discharged from the tub 12 may be disposed in the exhaust device 50. The first temperature sensor 210 may be disposed in the indoor air inlet duct 74 or the exhaust duct 52. The first temperature sensor 210 may detect the temperature of the air discharged from the tub 12 in the indoor air inlet duct 74. In addition, the first temperature sensor 210 may be disposed in the exhaust duct 52 to detect the temperature of air discharged through the exhaust duct 52. Depending on the disposition of the first temperature sensor 210, the set value of the air temperature detected by the first temperature sensor 210 may vary.

Figure 6A:
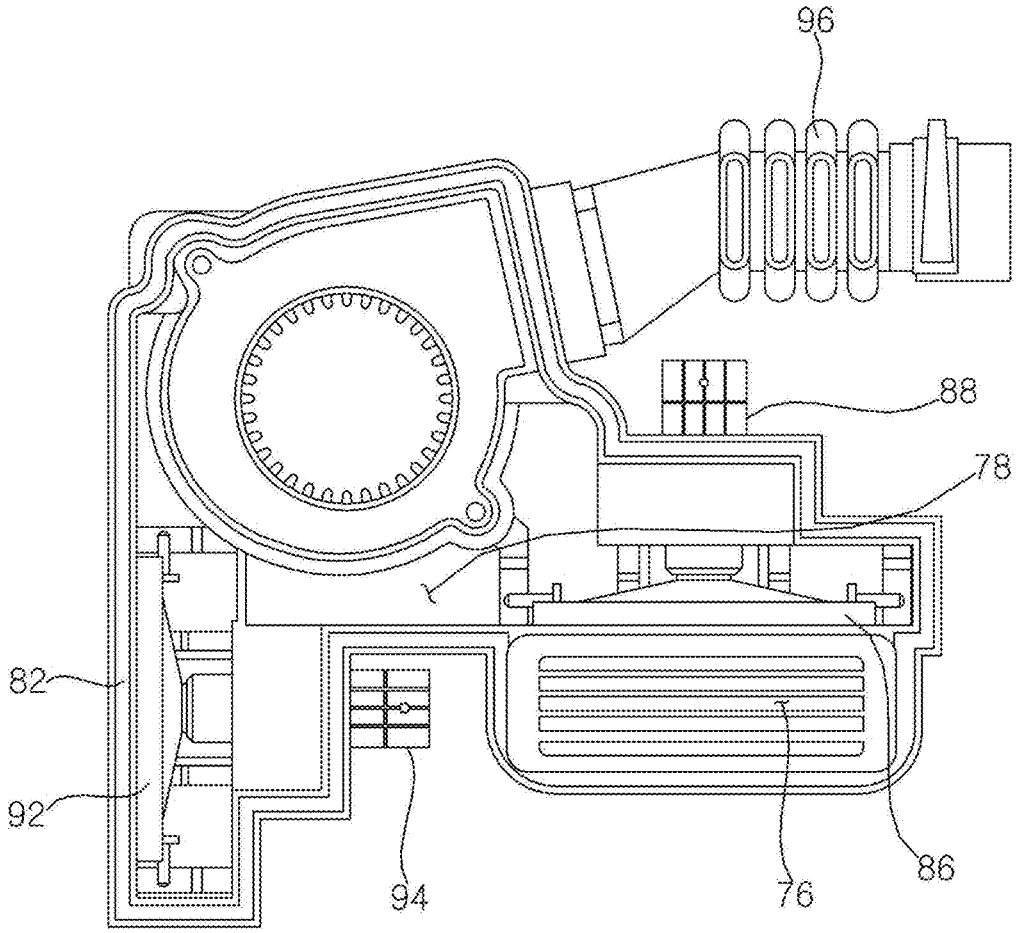
FIGS. 6A to 6C are diagrams for explaining the opening and closing of an indoor air inlet duct and an outdoor air inlet duct according to the operation of a first valve and a second valve according to an embodiment of the present disclosure.

The operation of the first valve 84 and the second valve 90 will be described with reference to FIGS. 6A to 6C.

When a drying mode DM for drying the washing space inside the tub 12 is not performed, the first valve 84 closes the indoor air inlet duct 74, and the second valve 90 closes the outdoor air inlet duct 80. That is, when a washing mode WM for washing the dishes disposed inside the washing space or a rinsing mode RM for rinsing dishes proceeds, the first valve 84 closes the indoor air inlet duct 74, and the second valve 90 closes the outdoor air inlet duct 80. Thus, the air inside the tub 12 does not flow to the outside through the exhaust duct 52.

Figure 6B:
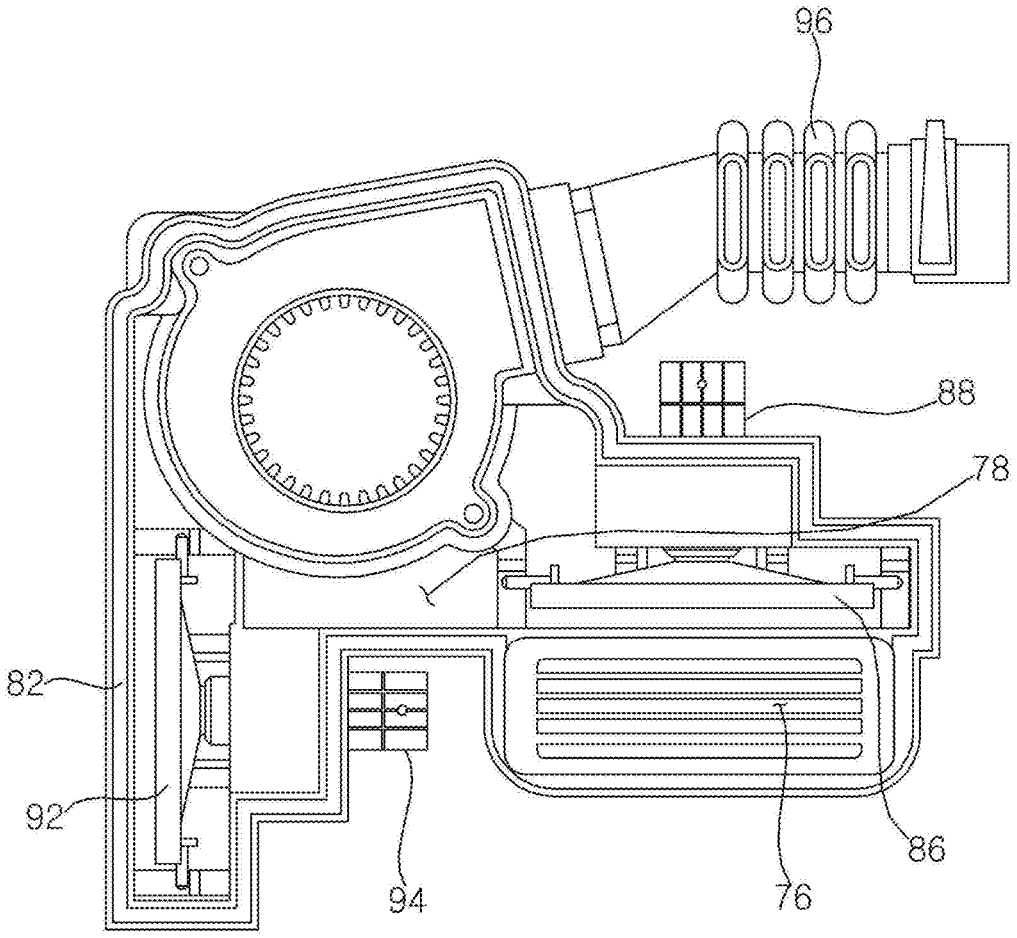
Figure 6C:
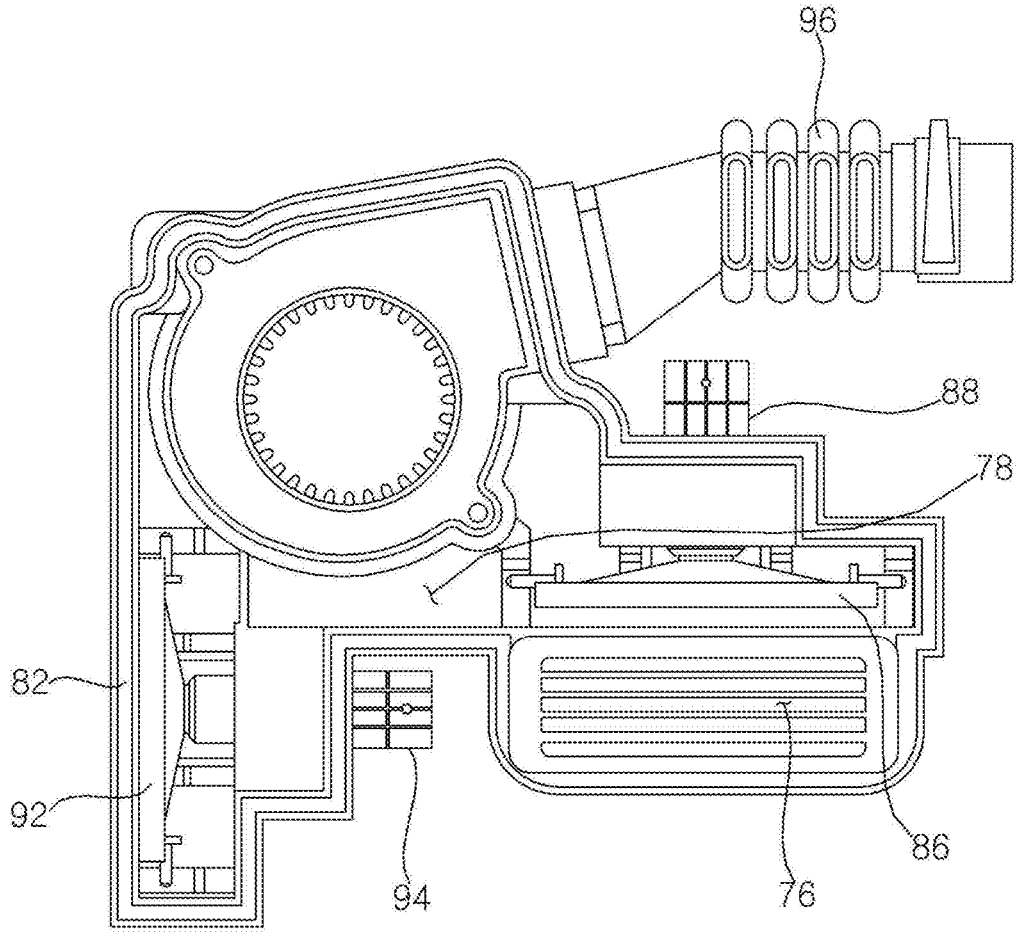

Referring to FIGS. 6B to 6C, when the drying mode DM proceeds, the first valve 84 and the second valve 90 may open both the indoor air inlet duct 74 and the outdoor air inlet duct 80, or only the first valve 84 may open the indoor air inlet duct 74.

When the drying mode DM starts, as shown in FIG. 6B, the first valve 84 and the second valve 90 may open both the indoor air inlet duct 74 and the outdoor air inlet duct 80, and may mix the air inside the tub 12 and the outdoor air to discharge to the exhaust duct 52. Before the drying mode DM is performed, the air temperature inside the tub 12 is formed to be a set temperature or higher. Thus, the temperature of the air that is mixed with the outdoor air and discharged through the exhaust duct 52 can be lowered.

In addition, when the drying mode DM is performed and the air temperature detected by the first temperature sensor 210 is formed to be a set temperature or lower, the second valve 90 closes the outdoor air inlet duct 80. That is, as shown in FIG. 6C, the first valve 84 opens the indoor air inlet duct 74 and the second valve 90 closes the outdoor air inlet duct 80, so that only the air inside the tub 12 may be discharged through the exhaust duct 52. Since only the air inside the tub 12 is discharged to the outside, the amount of air discharged from the tub 12 is increased, so that the inside of the tub 12 can be quickly dried.

The supply device 100 is disposed in one side of the tub 12, and supplies outdoor air to the washing space inside the tub 12. The supply device 100 heats outdoor air and supplies it to the inside of the tub 12. Accordingly, the washing space inside the tub 12 may be dried by supplying high-temperature dry air to the tub 12.

Figure 7:
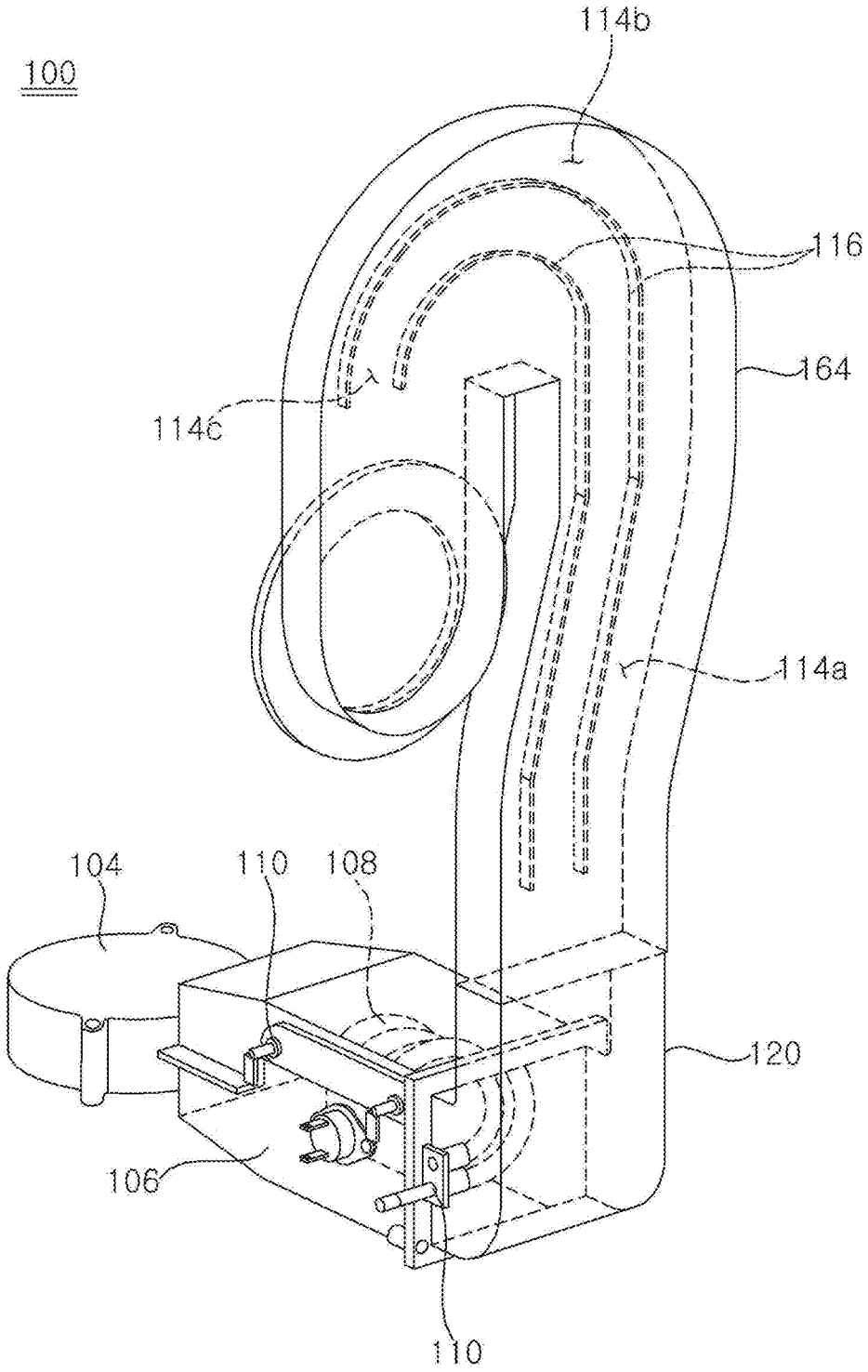
FIG. 7 is a perspective view of a supply device according to an embodiment of the present disclosure.

Referring to FIG. 7, the supply device 100 includes a supply fan 102 for supplying outdoor air to the tub 12, a supply fan housing 104 forming a space in which the supply fan 102 is disposed, a heating duct 106 disposed in one side of the supply fan housing 104 to guide the flowing air, a heater 108 disposed inside the heating duct 106 to heat the flowing air, and a supply duct 114 that is connected to the heating duct 106 and connects the heating duct 106 and one side of the tub 12.

Referring to FIG. 7, the supply fan housing 104 is disposed below the tub 12. The supply fan housing 104 has a fan inlet (not shown) formed in the lower side, and a fan outlet, which is connected to the heating duct 106, that is formed in one side of a circumferential surface.

The heating duct 106 is disposed below the tub 12. The heater 108 is disposed inside the heating duct 106 to heat the air flowing from the supply fan housing 104.

Figure 8:
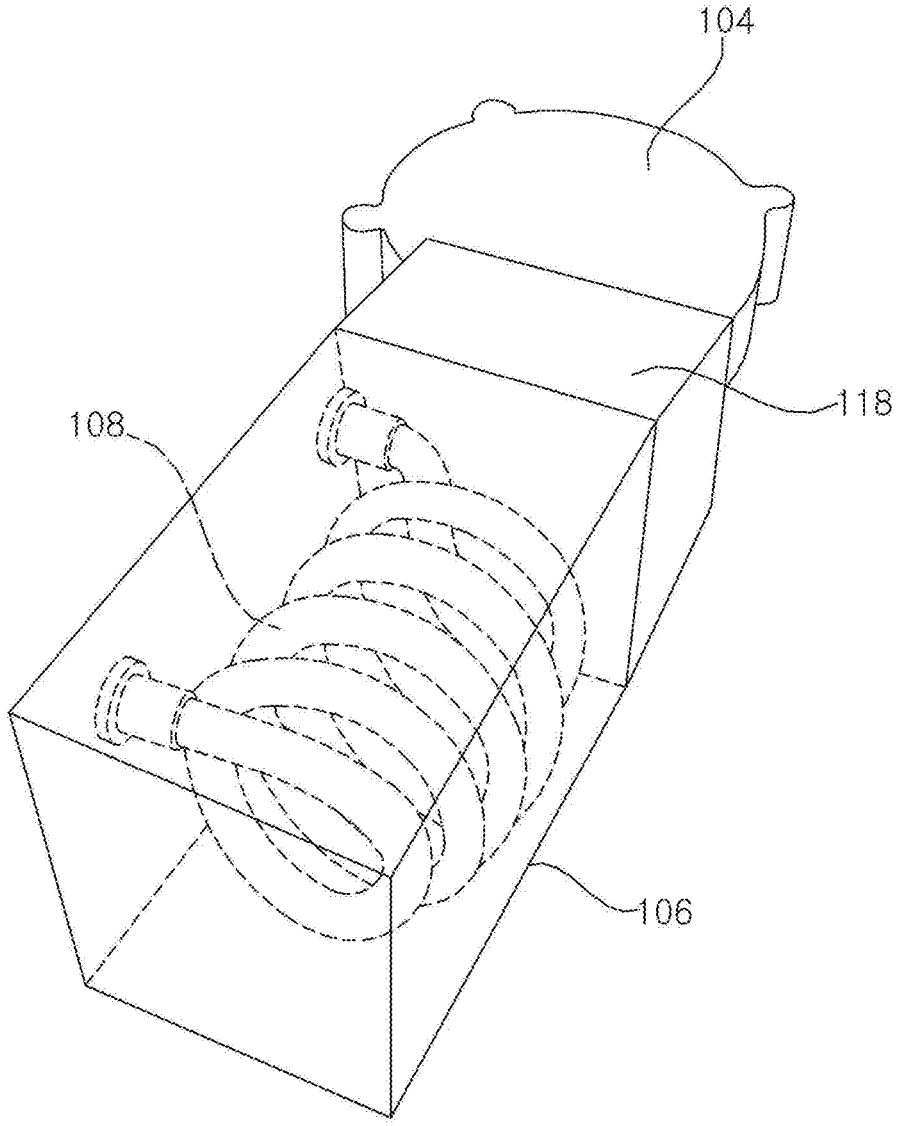
FIG. 8 is a diagram for explaining a heating duct and a heater according to an embodiment of the present disclosure.

The heater 108 may be formed in a coil shape inside the heating duct 106. The heating duct 106 has a structure extending in a direction in which the radial center of the coil shaped heater 108 extends. That is, referring to FIG. 8, the heating duct 106 forms a flow path in a direction in which the center of the coil extends. Referring to FIG. 8, the center line of the heating duct 106 is aligned with the center line of the heater 108. Thus, the air flowing through the heating duct 106 can be evenly heated as a whole. In addition, the air discharged from the heating duct 106 may have an even temperature distribution in the upper, lower, left, and right directions of a discharge end.

The heater 108 is a sheath heater type, and has a tubular type shape to maximize spatial efficiency within the heating duct 106. The heating duct 106 has a straight flow path. The center lines of the heating duct 106 and the heater 108 coincide, so that a uniform wind speed can be applied to the surface of the heater.

In the heater 108, a terminal unit 110 may be disposed in one side of the heating duct 106. One side of the heating duct 106 where the terminal unit 110 is disposed may have a relatively low temperature under the same wind speed condition. A thermostat 112 for detecting whether the heater 108 is overheated may be disposed in one side of the heating duct 106 where the terminal unit 110 is disposed. Since the thermostat 112 is disposed in an area where the temperature is relatively low in the heating duct 106, the temperature range of the heater 108 detected by the thermostat 112 can be set low. This can detect abnormal operation of the heater 108 quickly.

An expansion duct 118 having an expanded cross-sectional area of flow path may be disposed between the supply fan housing 104 and the heating duct 106. The expansion duct 118 may have a cross-sectional area of the flow path expanded from a discharge end of the supply fan housing 104 in the up-down direction. In the heating duct 106, the cross-sectional area of the flow path expanded in the expansion duct 118 may be maintained.

A bending portion 120 connecting the heating duct 106 disposed below the tub 12 and the supply duct 114 disposed in the lateral surface of the tub 12 is disposed between the heating duct 106 and the supply duct 114. The bending portion 120 may allow air discharged from the heating duct 106 to flow upward.

In the inside of the supply duct 114, an ascending passage 114*a* for sending the air discharged from the heating duct 106 upward, a change passage 114*b* for changing the flow direction of the air flowing in the ascending passage 114*a* downward, and a descending passage 114*c* for flowing the air flowing through the change passage 114*b* downward are formed. The supply duct 114 and the tub 12 may communicate with each other in the lower end of the descending passage 114*c*. Accordingly, the water scattered inside the tub 12 may be prevented from flowing into the supply duct 114 and flowing into the heater 108 inside the heating duct 106.

In the inside of the supply duct 114, a guide rib 116 for guiding the flow of air in a direction in which the flow path extends may be formed.

A second temperature sensor 220 for detecting the temperature of the air discharged from the heating duct 106 may be disposed in the supply device 100. In the heating duct 106 of the present disclosure, since the overall temperature deviation at the discharge end is not severe, the second temperature sensor 220 may be freely disposed.

Referring to FIGS. 9A to 10B, it is possible to compare the discharge temperature distribution of the heating duct 106 of the present disclosure with the discharge temperature distribution of the heating duct of another structure of the comparable disclosure.

Figure 9A:
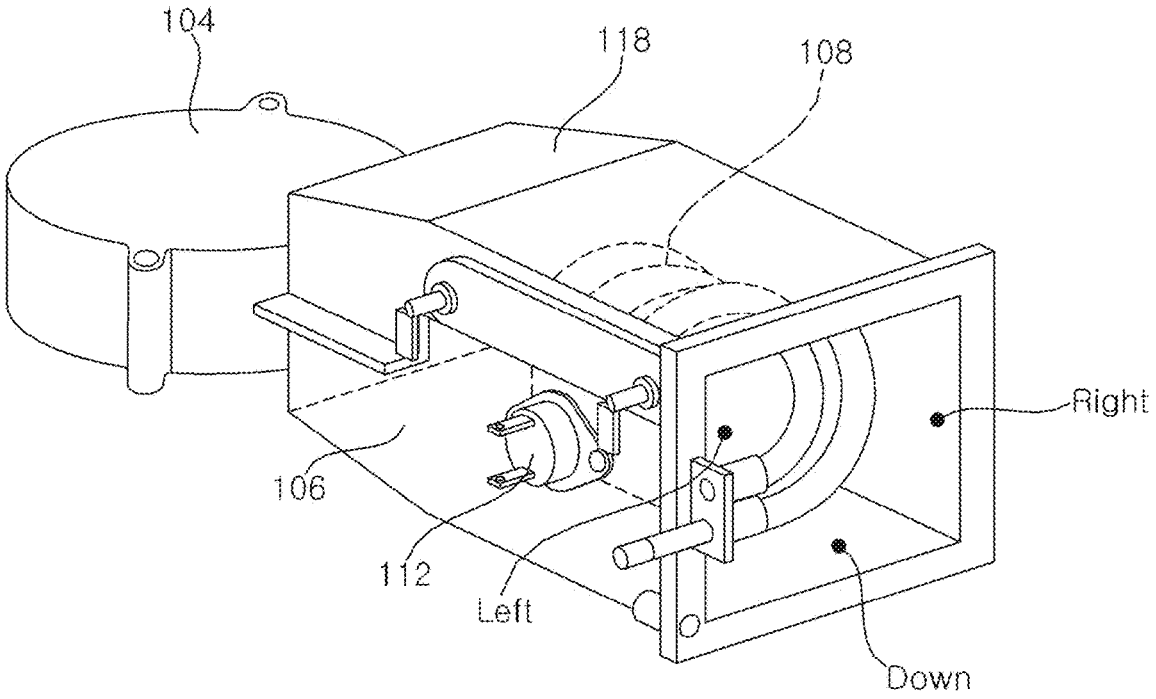
FIG. 9A is a heating duct and a heater according to an embodiment of the present disclosure.
Figure 9B:
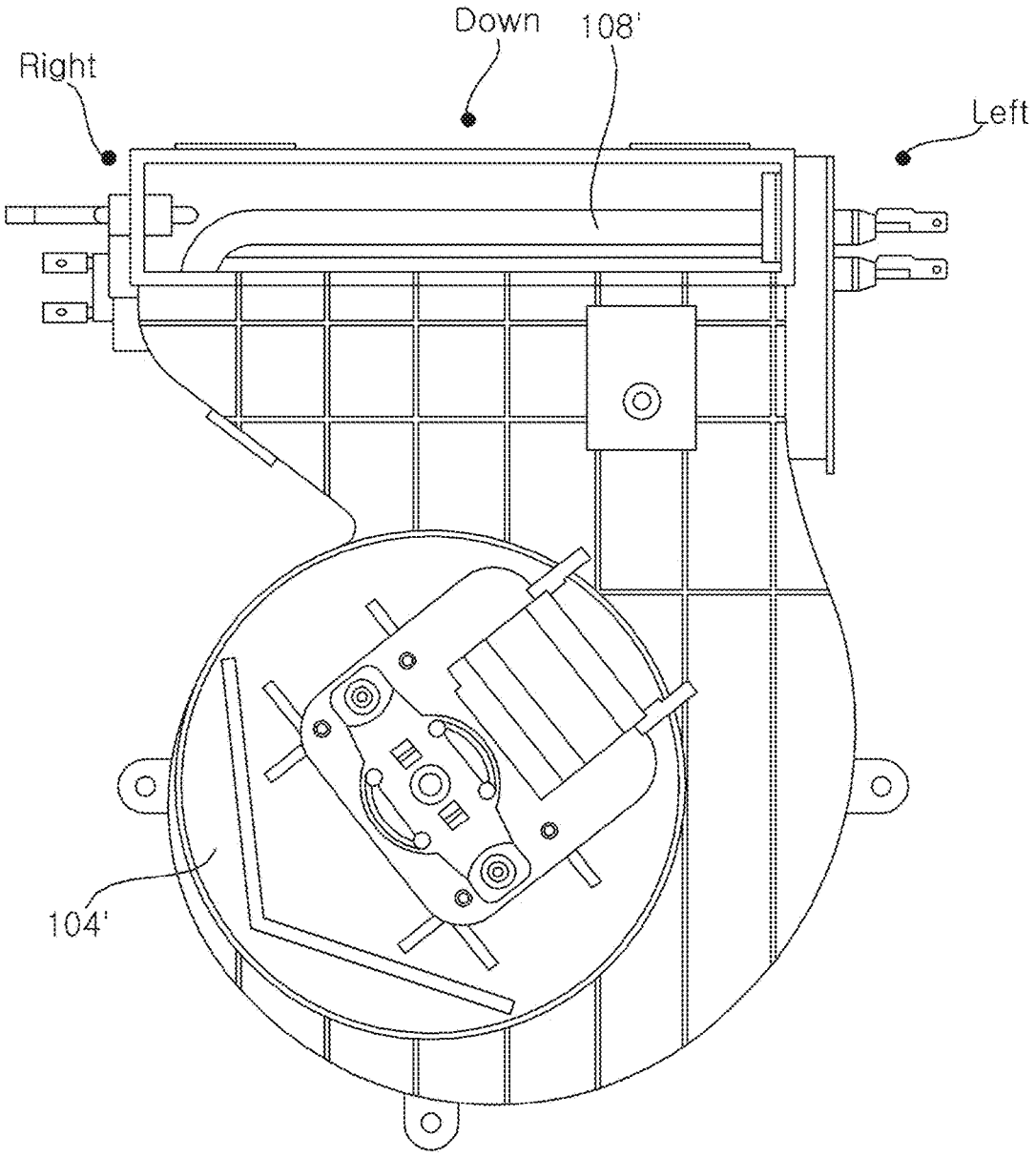
FIG. 9B is a diagram of a heating duct and a heater according to a comparable disclosure.
Figure 10A:
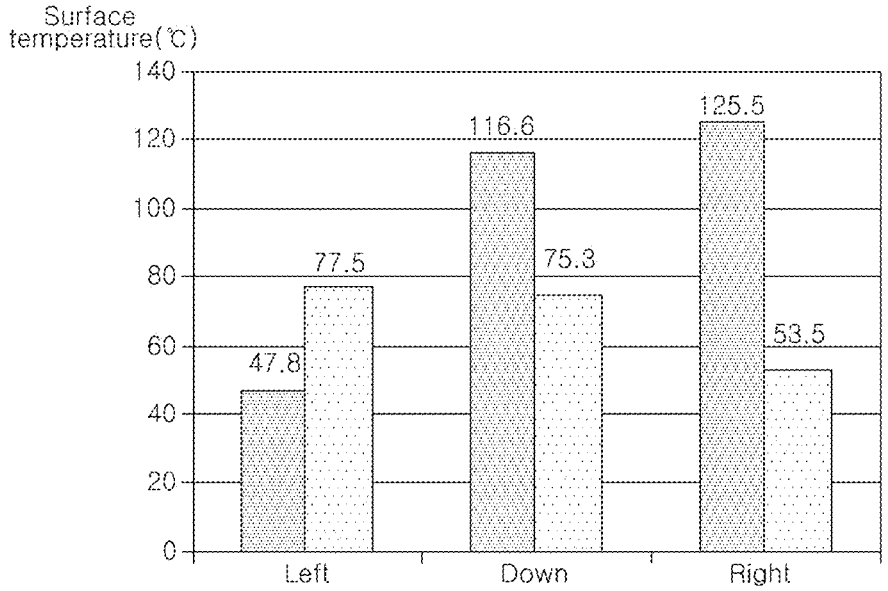
FIGS. 10A and 10B are data showing the temperature distribution of the left, right, and lower sides of the air discharged from the heating duct of each of FIGS. 9A and 9B.
Figure 10B:
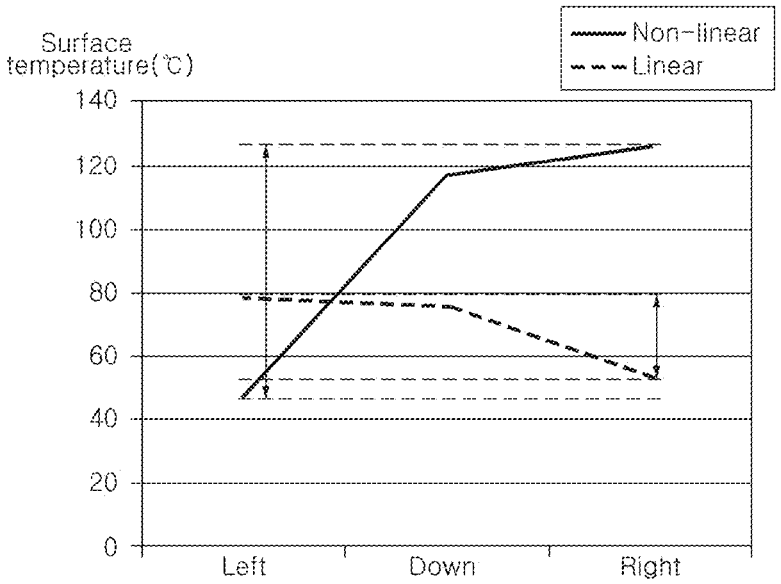

FIGS. 9A and 9B are diagrams showing disposition of a heating duct and a heater of the present disclosure and the comparable disclosure.

The heater 108 of the present disclosure is disposed in the direction in which the heating duct 106 extends. In addition, the heating duct 106 of the present disclosure extends in the direction in which the center of the coil of the heater 108 extends. Meanwhile, referring to FIG. 9B, the heater ' of the comparable disclosure is disposed perpendicular to the direction in which air flows to the heating duct 106. In addition, the heating duct 106 extends from the fan housing in an asymmetrical structure.

Therefore, in the heating duct of the comparable disclosure, a large temperature difference between the lower sides of the left side and the right side of the discharge end may occur. That is, referring to FIGS. 10A and 10B, it can be checked that the temperature of the left and right sides of the discharge end is 80 degrees or higher, in the heating duct of the comparable disclosure. This may cause a problem that the operation of the heater 108 cannot be properly checked depending on where the temperature sensor is placed in the discharge end of the heating duct 106.

Meanwhile, the heating duct 106 of the present disclosure forms a flow path in the direction in which the heater 108 extends. Specifically, the flow path of the heating duct 106 is formed to extend in the direction in which the center of the coil-shaped heater 108 extends, so that the temperature of the discharge end of the heating duct 106 does not have a large difference in the left or right side. That is, referring to FIGS. 10A and 10B, in the heating duct 106 of the present disclosure, it can be checked that the temperature of the left and right sides of the discharge end is formed within 40 degrees. That is, it can be checked that the temperature difference at the discharge end is formed within 50% compared to the comparable disclosure. Thus, a large temperature difference between one side and the other side at the discharge end of the heating duct 106 does not occur, so that the degree of freedom in the disposition of the temperature sensor can be increased. In addition, the accuracy of the temperature discharged from the heating duct 106 may be increased.

Figure 11:
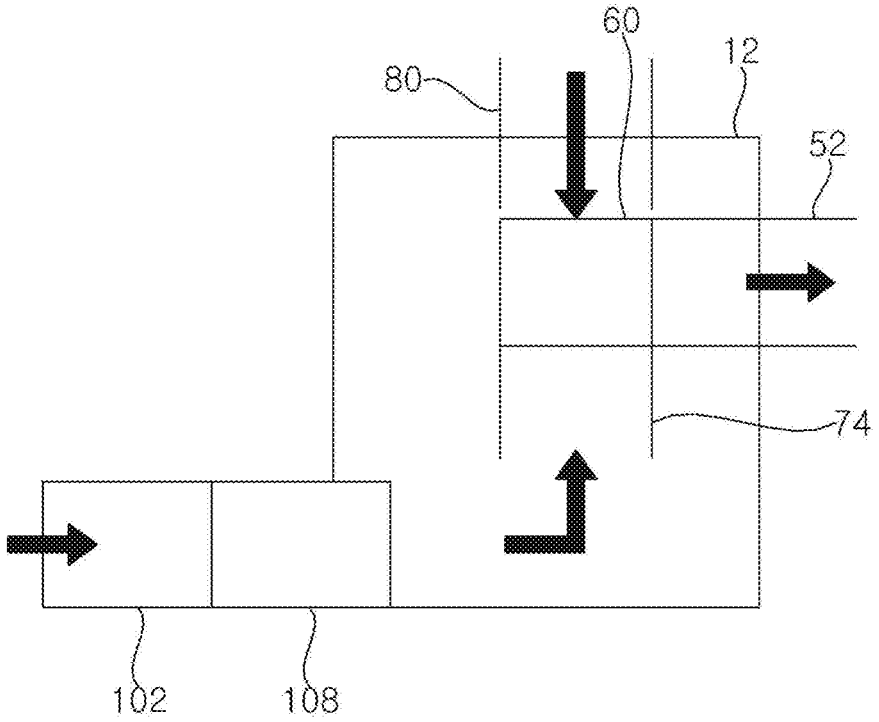
FIG. 11 is a schematic diagram showing the flow of air in a drying mode of a dishwasher according to an embodiment of the present disclosure.

FIG. 11 is a diagram schematically illustrating the flow of air, when the dishwasher of the present disclosure performs the drying mode.

Referring to FIG. 11, the air inside the tub 12 may be discharged to the outside through the exhaust device 50. At this time, the exhaust fan 60 operates to discharge the air inside the tub 12 to the outside. In addition, the first valve 84 and the second valve 90 may open both the indoor air inlet duct 74 and the outdoor air inlet duct 80, and mix the air inside the tub 12 with the outdoor air and discharge the mixed air to the outside. In addition, the first valve 84 may open only the indoor air inlet duct 74 to discharge only the air inside the tub 12 to the outside.

In addition, the supply device 100 may supply outdoor air into the tub 12. That is, the supply fan 102 may operate to supply outdoor air into the tub 12. At this time, the heater 108 may operate to heat the air supplied to the tub 12.

Figure 12:
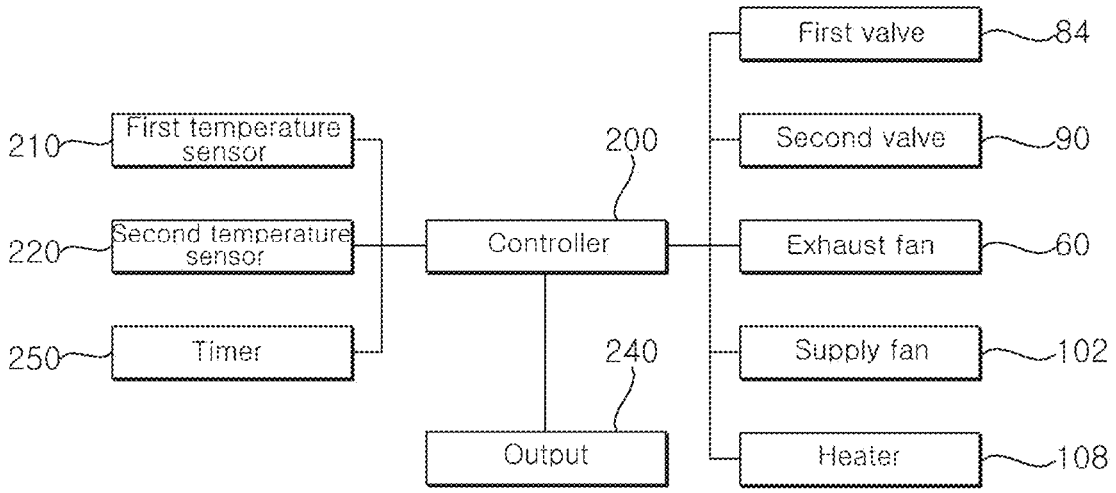
FIG. 12 is a block diagram of a controller and related components of a dishwasher according to an embodiment of the present disclosure.

Referring to FIG. 12, a controller 200 for operating the dishwasher 1 of the present disclosure and its related components will be described.

The controller 200 may operate the first valve 84 to open and close the indoor air inlet duct 74 or operate the second valve 90 to open and close the outdoor air inlet duct 80. The controller 200 may operate the exhaust fan 60.

The controller 200 may operate the exhaust fan 60 and operate each of the first valve 84 and the second valve 90, in the drying mode DM. The controller 200 may adjust the second valve 90 according to the temperature value detected by the first temperature sensor 210. In addition, the controller 200 may adjust the second valve 90 based on the time measured by the timer 230 when the drying mode DM is operated.

The controller 200 may operate the supply fan 102 and the heater 108. The controller 200 may determine whether the supply fan 102 or the heater 108 is failed based on the temperature change detected by the second temperature sensor 220. When determining whether at least one of the supply fan 102 or the heater 108 is failed, the controller 200 may inform a user of an error through the output unit 240.

Figure 13:
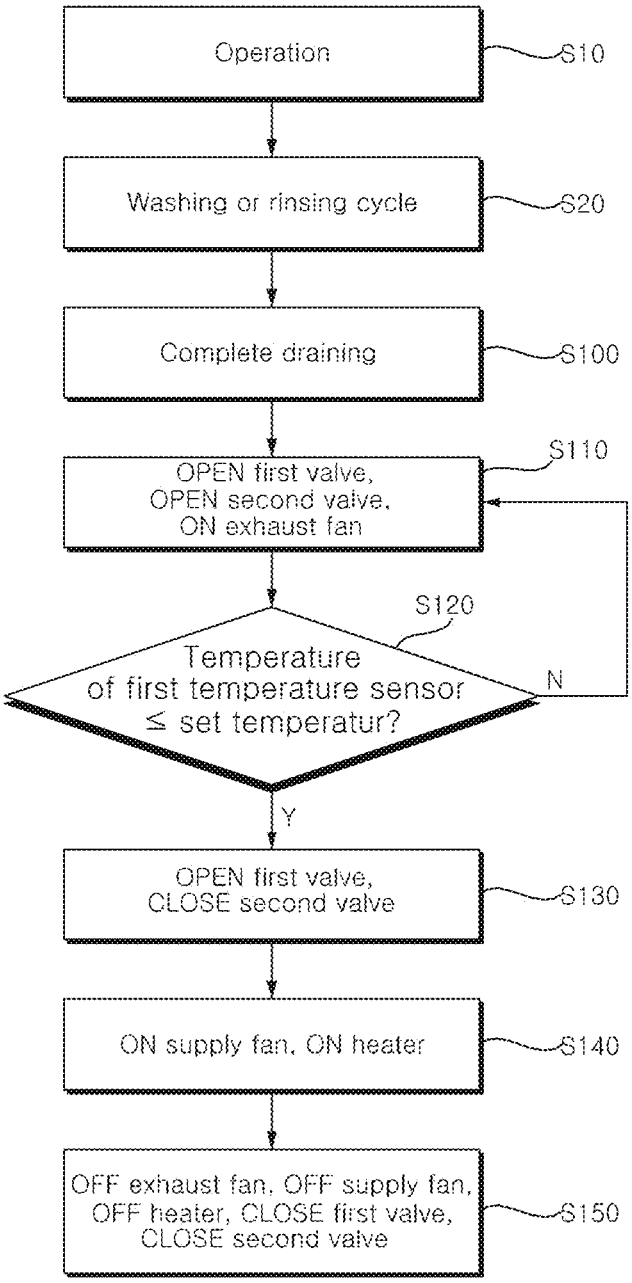
FIG. 13 is a flowchart of a method for controlling a drying mode of a dishwasher according to an embodiment of the present disclosure.
Figure 14:
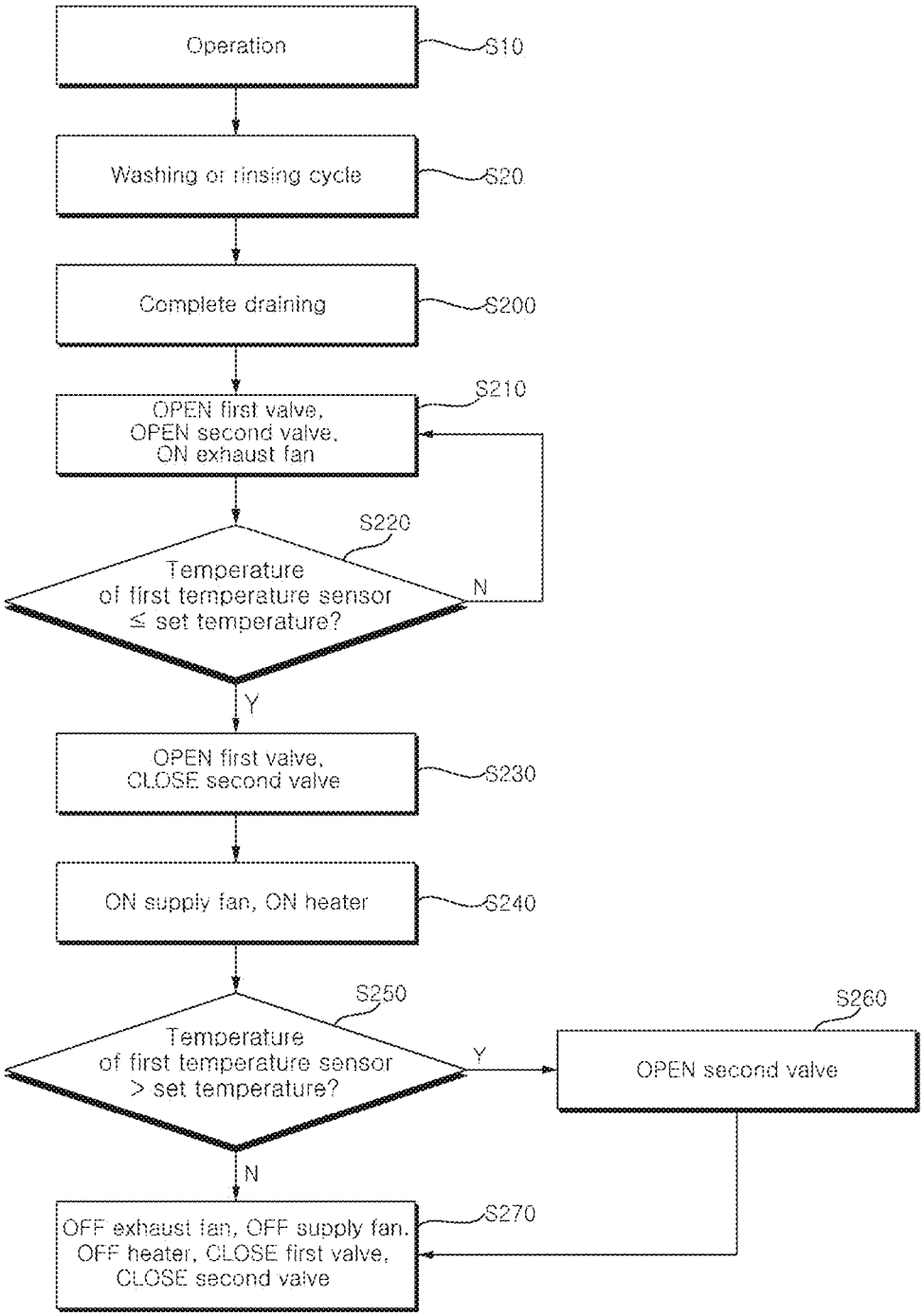
FIG. 14 is a flow chart of a method for controlling a drying mode of a dishwasher according to another embodiment of the present disclosure.

Referring to FIGS. 13 and 14, a method of controlling the dishwasher when operating in a drying mode will be described.

First, referring to FIG. 13, a control method of the dishwasher according to the first embodiment will be described.

When the dishwasher is operated (S10), and the washing mode of washing dishes in the washing space or the rinsing mode of rinsing dishes is completed (S20), a step of draining water from the sump (not shown) is performed (S100). Thereafter, a drying mode for drying dishes disposed in the washing space is performed.

In the drying mode, a step S110 of firstly opening the indoor air inlet duct 74 by the first valve 84, opening the outdoor air inlet duct 80 by the second valve 90, and operating the exhaust fan 60 to mix the air inside the tub 12 with outside air and discharge the mixed air is performed.

In a state where the washing mode or rinsing mode is finished, when the air inside the tub 12 is discharged directly through the exhaust duct 52 in a heated state, hot air is discharged to the outside of the dishwasher 1, thereby causing a user's safety problem. Therefore, in an initial stage of the drying mode, both the outdoor air inlet duct 80 and the indoor air inlet duct 74 are opened through the first valve 84 and the second valve 90, so that the air inside the tub 12 is mixed with outdoor air and sent to the exhaust duct 52. In this case, the temperature of the air discharged through the exhaust duct 52 is lowered, thereby solving the user's safety problem.

Thereafter, after a step of comparing the temperature of the air detected by the first temperature sensor 210 with a set temperature (S120), when the temperature of the air detected by the first temperature sensor 210 is equal to or less than the set temperature, the outdoor air inlet duct 80 is closed through the second valve 90 (S130). At this time, the operation of the exhaust fan 60 may be maintained. The set temperature is a temperature at which safety problems are resolved for a user, and may be set through data such as experiments. In the present disclosure, the set temperature may be set based on 50 degrees. However, these set values may vary depending on the use of the dishwasher or a disposition area.

When the air inside the tub 12 mixed with the outdoor air is discharged through the exhaust duct 52, there is an advantage that the temperature of the air discharged through the exhaust duct 52 can be lowered, but there is a disadvantage that the performance time of the drying mode may take longer.

Therefore, when the temperature of the air discharged from the exhaust duct 52 is the set temperature or less, the outdoor air inlet duct 80 is closed through the second valve 90, thereby discharging only the air inside the tub 12 through the exhaust duct 52.

At this time, since only the air of the tub 12 is discharged to the outside, the drying mode can proceed rapidly.

In addition, a step (S140) of operating the supply fan 102 and operating the heater 108 is performed so that the heated outdoor air is supplied to the tub 12. Since high-temperature dry air is supplied to the tub 12, the drying mode DM may proceed more rapidly.

Thereafter, when a drying set time is reached, the operation of the exhaust fan 60 and the supply fan 102 is stopped (S150). In addition, the operation of the heater 108 may be stopped, and the indoor air inlet duct 74 may be closed through the first valve 84.

Referring to FIG. 14, a control method of the dishwasher according to a second embodiment will be described.

Steps S10 to S240 in FIG. 14 may be performed in the same manner as steps S10 to S140 in FIG. 13.

Differences between the control method of the dishwasher according to the second embodiment and the control method according to the first embodiment will be mainly described.

A step S240 of operating the supply fan 102 and operating the heater 108 proceeds, and the air inside the tub 12 may rise as the air heated by the heater 108 is supplied to the tub 12. That is, the temperature of the air discharged from the tub 12 to the exhaust duct 52 may increase. Therefore, after a step S250 of comparing the temperature of the air detected by the first temperature sensor 210 with a set temperature, when the temperature of the air detected by the first temperature sensor 210 exceeds the set temperature, the second valve 90 opens the outdoor air inlet duct 80 (S260). Accordingly, the air discharged from the tub 12 is mixed with outdoor air, and discharged through the exhaust duct 52.

Thereafter, when the drying set time is reached, the operation of the exhaust fan 60 and the supply fan 102 is stopped (S270). In addition, the operation of the heater 108 may be stopped, and the indoor air inlet duct 74 and the outdoor air inlet duct 80 may be closed through the first valve 84 and the second valve 90.

Figure 15:
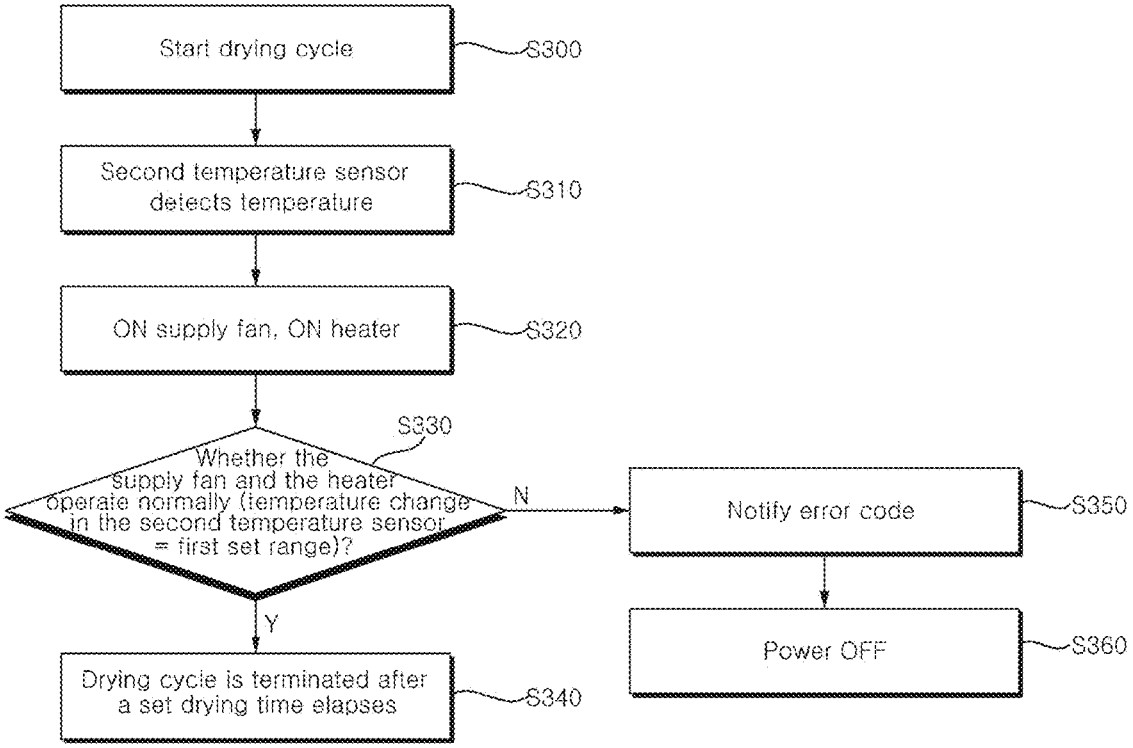
FIG. 15 is a control method of a dishwasher for detecting failure of a supply fan or heater of a supply device according to an embodiment of the present disclosure.
Figure 16:
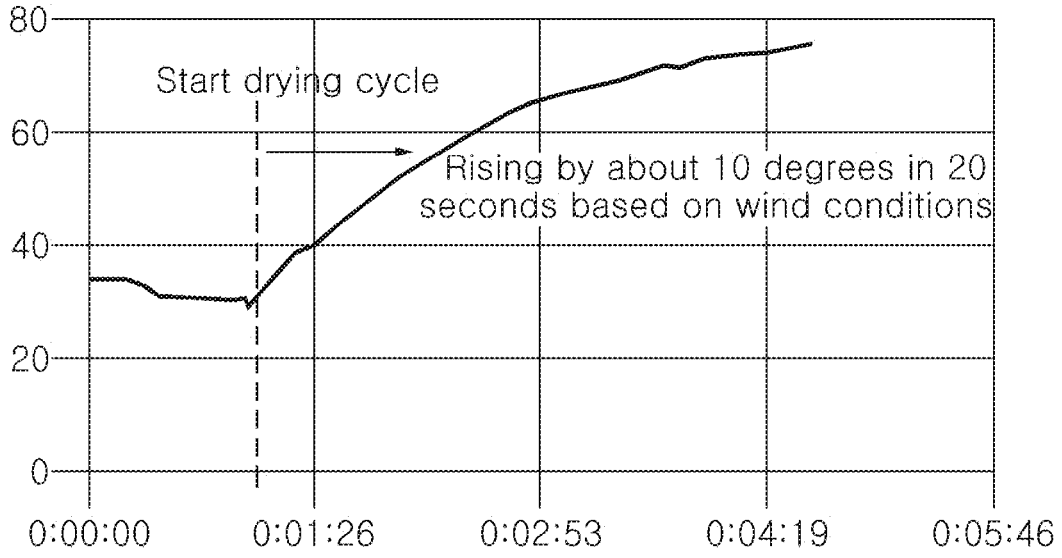
FIG. 16 is a diagram showing a change in temperature of the heating duct, when a drying cycle proceeds.
Figure 17:
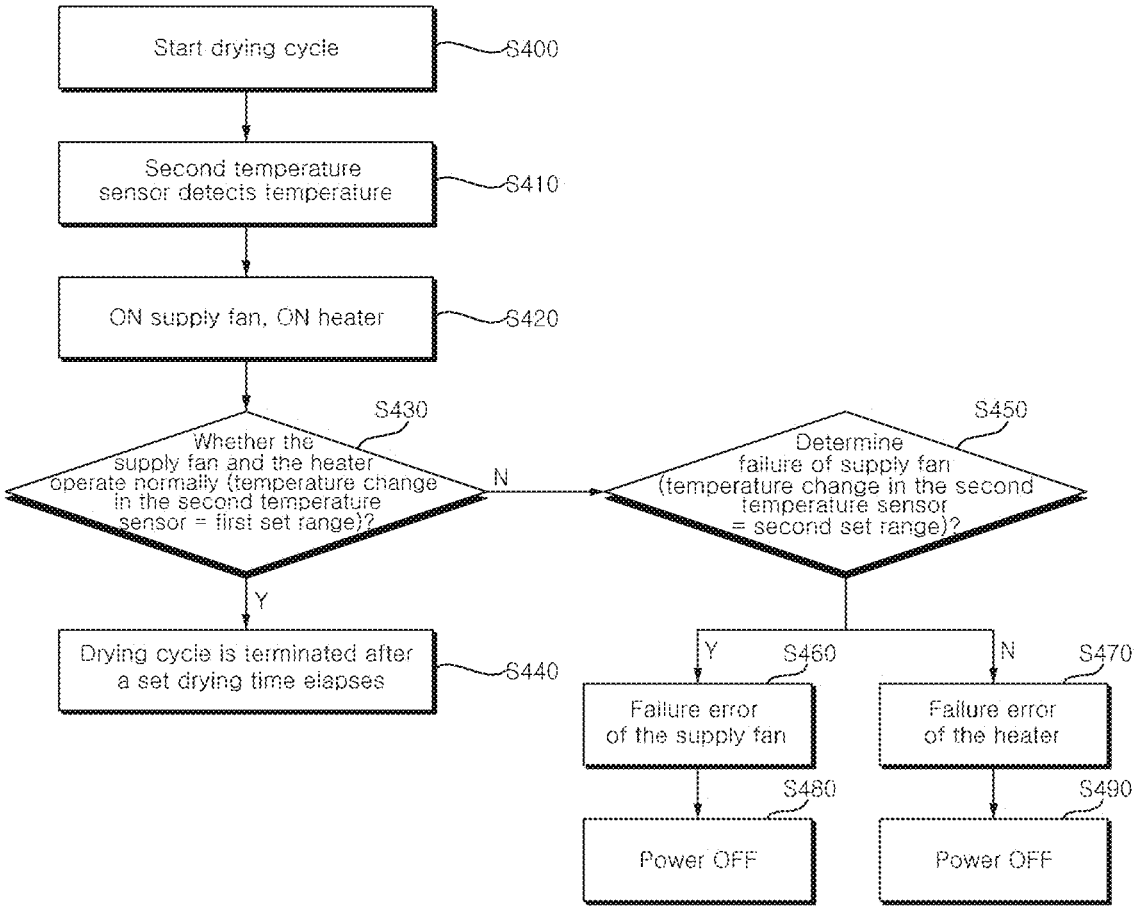
FIG. 17 is a control method of a dishwasher for detecting failure of a supply fan or heater of a supply device according to another embodiment of the present disclosure.

Referring to FIGS. 15 to 17, a method of determining whether the heater 108 or the supply fan 102 of the supply device 100 is failed, and controlling the dishwasher for performing a drying mode when a failure is determined will be described.

First, a control method of the dishwasher related to the failure of the heater 108 or the supply fan 102 and the performance of the drying mode according to the first embodiment will be described.

After the drying mode DM starts (S300), the second temperature sensor 220 detects the temperature discharged from the heating duct 106 (S310). The second temperature sensor 220 measures the temperature before the supply fan 102 and the heater 108 operate, and may detect a temperature change according to the operation of the supply fan 102 and the heater 108.

Thereafter, a step S320 of operating the supply fan 102 and the heater 108 is performed. As the supply fan 102 and the heater 108 operate, hot dry air may be supplied into the tub 12.

Thereafter, the second temperature sensor 220 detects a change in temperature of the air flowing through the supply device 100 for a set time.

A step S330 of determining whether the supply fan 102 and the heater 108 operate normally is performed. Whether the supply fan 102 and the heater 108 operate normally is determined by whether the temperature change detected by the second temperature sensor 220 is within a first set range. That is, it can be determined based on whether the slope value of the temperature change detected by the second temperature sensor 220 is within the first set range.

Here, the set range may be set based on experimental data of temperature change, when the supply fan 102 and the heater 108 operate normally. Accordingly, the first set range may include a minimum temperature value and a maximum temperature value.

Referring to FIG. 16, when the drying cycle starts and the heater 108 and the supply fan 102 operate normally, the temperature detected by the second temperature sensor 220 increases. At this time, the rate of temperature increase may increase by 10 degrees in approximately 20 seconds. Based on this, the first set range has a change rate of 0.5 degrees per unit time. Through repetitive experiments, the change rate of temperature may be formed in the range of 0.3 degrees to 0.7 degrees per unit time. At this time, the first set range may be formed in the range of 0.3 degrees to 0.7 degrees per unit time.

In addition, referring to FIG. 16, when the drying cycle starts and the heater 108 and the supply fan 102 operate normally, the change in temperature detected by the second temperature sensor 220 finally converges. Therefore, the temperature change rate can be measured within the first set time.

When the temperature change detected by the second temperature sensor 220 is within the first set range, it is determined that the supply fan 102 and the heater 108 are operating normally. In addition, when the temperature change detected by the second temperature sensor 220 deviates from the first set range, it may be determined that the supply fan 102 and the heater 108 are operating abnormally.

When it is determined that the supply fan 102 and the heater 108 are operating normally, and if the set drying time elapses, the drying mode DM is terminated (S340).

When it is determined that the supply fan 102 and the heater 108 are operating abnormally, an error code is notified to a user through the output unit 240 (S350), and power may be terminated (S360).

Hereinafter, referring to FIG. 17, a method of controlling a dishwasher related to the failure of the heater 108 or the supply fan 102 and the performance of the drying mode according to the second embodiment will be described. Hereinafter, a control method of the dishwasher related to the failure of the heater 108 or supply fan 102 and the performance of the drying mode according to the second embodiment will be described mainly based on differences from the first embodiment.

Steps S300 to S340 in FIG. 15 may proceed in the same manner as steps S400 to S440 in FIG. 17.

Referring to FIG. 17, when it is determined that the supply fan 102 and the heater 108 are operating abnormally, a step S450 of determining failure of each of the supply fan 102 and the heater 108 is performed. Failure determination of each of the supply fan 102 and the heater 108 may be determined based on whether the temperature change detected by the second temperature sensor 220 is within a second set range. Here, the second set range may be formed with a value smaller than the first set range. That is, the temperature change in the second set range may be smaller than the temperature change in the first set range.

When the temperature change detected by the second temperature sensor 220 satisfies the second set range, it may be determined that the supply fan 102 has failed. When the temperature change detected by the second temperature sensor 220 does not satisfy the second set range, it may be determined that the heater 108 has failed. When the supply fan 102 fails, the temperature change of the second temperature sensor 220 is detected, but the change rate is formed to be slow. However, when the heater 108 fails, the temperature change of the second temperature sensor 220 is hardly detected.

Figure 18:
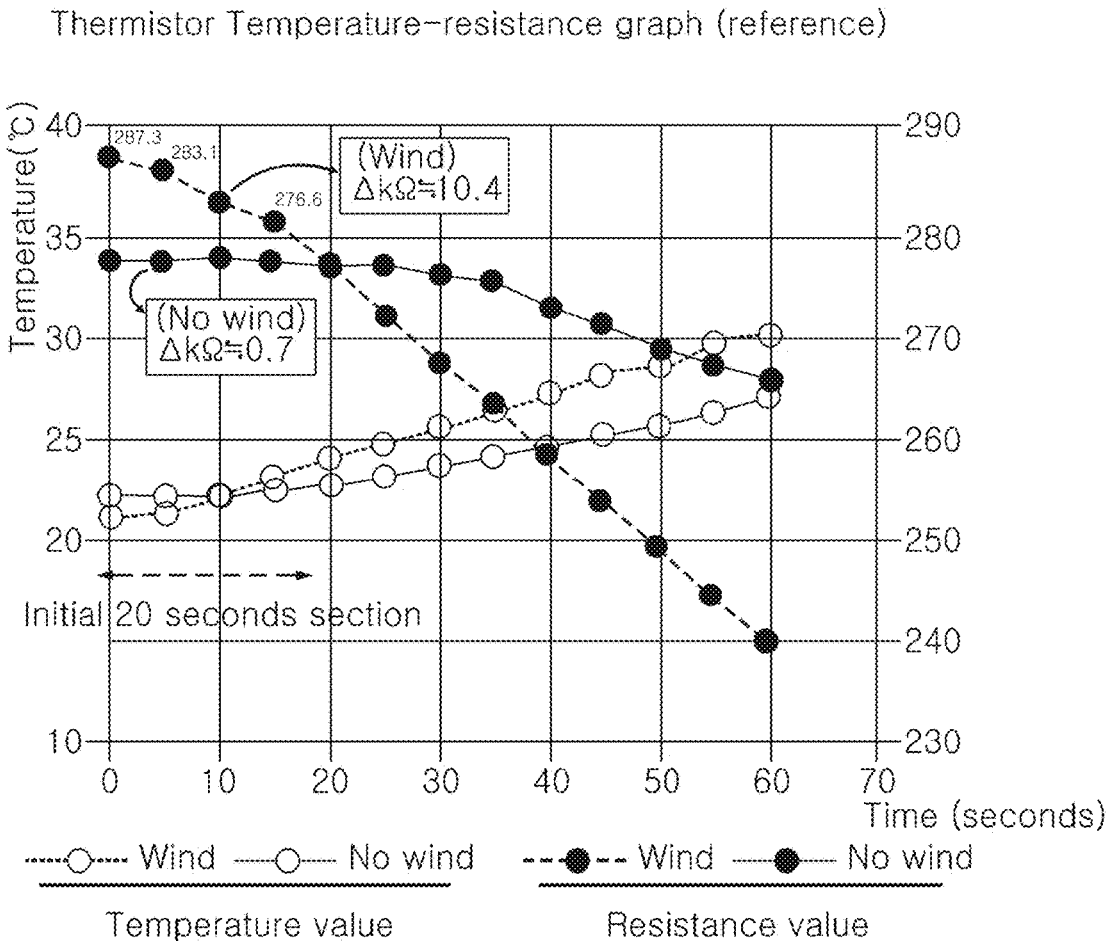
FIG. 18 is a diagram showing a temperature change and a resistance change of a temperature sensor for detecting the temperature of a heating duct, when a supply fan is operating and not operating according to an embodiment of the present disclosure.

Referring to FIG. 18, the temperature change rate when the supply fan 102 is not operating is formed to be smaller than the temperature change rate when the supply fan 102 is operating. Referring to FIG. 18, it can be checked that the temperature change rate is significantly changed after the drying cycle starts and a certain time is elapsed. Therefore, whether the temperature change within the second set range is satisfied by the second temperature sensor 220 may be determined after the second set time. The second set time may be greater than the first set time.

Referring to FIG. 18, it can be checked that the resistance value of the second temperature sensor 220 is different between when the supply fan 102 is operating and when the supply fan 102 is not operating. It can be checked that when the supply fan 102 does not operate, the change rate of the resistance value is formed to be smaller.

Accordingly, the step S450 of determining the failure of each of the supply fan 102 and the heater 108 may be determined based on the change rate of the resistance value detected by the second temperature sensor 220. That is, when the change rate of the resistance value of the second temperature sensor 220 is smaller than the set resistance value, the failure of the supply fan 102 may be determined. Here, the set resistance value may be set to a change rate of the resistance value that appears when the supply fan 102 and the heater 108 are operating normally, according to the experimental results.

When the supply fan 102 fails, a step S460 of outputting a failure error of the supply fan 102 through the output unit 240 may be performed, and the power may be terminated (S480). In addition, when the heater 108 fails, a step S470 of outputting a failure error of the heater 108 through the output unit 240 may be performed, and the power may be terminated (S490).

Hereinafter, with reference to FIG. 19, a method of controlling a dishwasher related to the failure of the heater 108 or the supply fan 102 and the performance of the drying mode according to the third embodiment will be described. Hereinafter, a control method of the dishwasher related to the failure of the heater 108 or supply fan 102 and the performance of the drying mode according to a third embodiment will be described mainly based on differences from the second embodiment.

Figure 19:
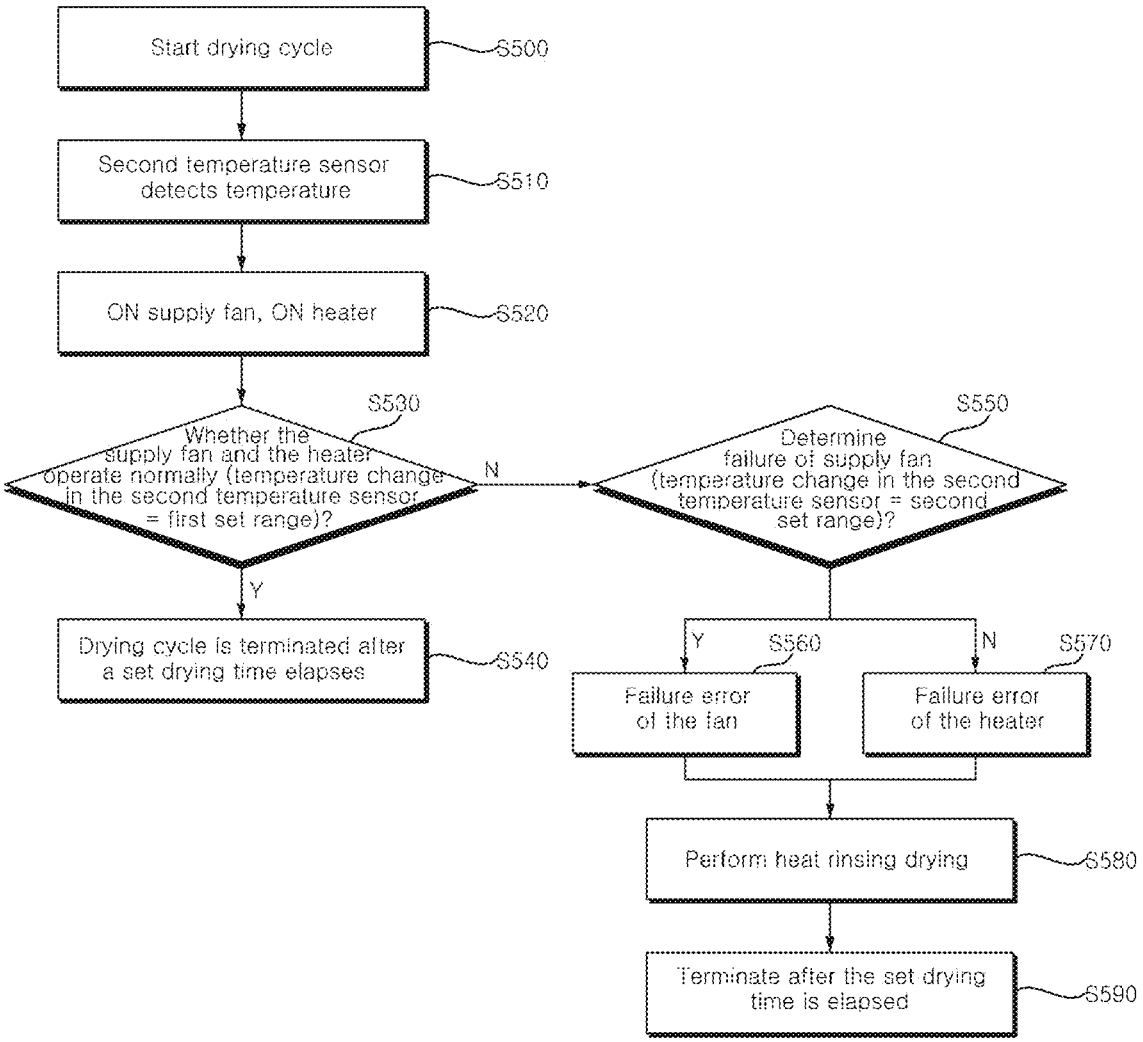
FIG. 19 is a control method of a dishwasher for detecting failure of a supply fan or heater of a supply device according to another embodiment of the present disclosure.

Steps S400 to S470 in FIG. 17 may be performed in the same manner as steps S500 to S570 in FIG. 19.

After the steps S560 and S570 of outputting a failure error of the heater 108 or the supply fan 102 through the output unit 240, a heat rinsing drying step S580 is performed. In the heat rinsing drying step S580, steam may be supplied to the tub 12 by heating water existing in a sump (not shown) or a wash pump (not shown). Accordingly, dishes disposed inside the tub 12 may be heated.

After the set drying time is elapsed, the drying mode DM is terminated (S590), and it is possible to output that drying through heat rinsing is performed through the output unit 240. A user may additionally open the door 20 to dry dishes existing inside the tub 12.

Although the present disclosure has been described with reference to specific embodiments shown in the drawings, it is apparent to those skilled in the art that the present description is not limited to those exemplary embodiments and is embodied in many forms without departing from the scope of the present disclosure, which is described in the following claims. These modifications should not be individually understood from the technical spirit or scope of the present disclosure.

The invention claimed is:

1. A method of controlling a dishwasher including a tub defining a washing space, a supply fan configured to supply outdoor air to the tub, a heating duct configured to guide the outdoor air towards the tub, a heater configured to heat the outdoor air in the heating duct, and a temperature sensor configured to determine a temperature of the outdoor air from the heating duct, the method comprising:

measuring, by the temperature sensor, a change of a temperature of air supplied to the tub through the heating duct;

operating the supply fan configured to supply outdoor air to the heating duct; operating the heater disposed at the heating duct;

determining, based on a slope value of the change of the temperature detected by the temperature sensor being within a first set range, that the supply fan and the heater are normally operating; and determining, based on the slope value of the change of the temperature detected by the temperature sensor being outside the first set range, at least one of a failure of the supply fan or a failure of the heater, wherein the failure of the supply fan and the failure of the heater are determined based on whether the slope value of the change of the temperature detected by the temperature sensor is within a second set range, wherein the second set range corresponds to temperature values lower than those of the first set range, and wherein the failure of the supply fan is determined based on the slope value of the change of the temperature detected by the temperature sensor being within the second set range.

2. The method of claim 1, further comprising:

generating, based on the slope value of the change of the temperature detected by the temperature sensor being outside of the first set range, an error code through an output unit.

3. The method of claim 1, further comprising:

stopping, based on the supply fan and the heater normally operating, operation of the supply fan and the heater after a predetermined drying time.

4. The method of claim 1, further comprising:

determining, based on the slope value of the change of the temperature detected by the temperature sensor not being within the first set range and not being within the second set range, the failure of the heater.

5. The method of claim 1, wherein the failure of each of the supply fan and the heater is determined based on a resistance value of the temperature sensor.

6. The method of claim 5, further comprising:

determining, based on the resistance value of the temperature sensor being smaller than a set resistance value, the failure of the supply fan.

7. The method of claim 1, further comprising:

determining the failure of each of the supply fan and the heater is performed, after a set time from the step of determining whether the supply fan and the heater are normally operating.

8. The method of claim 1, further comprising:

generating, based on determining the failure of at least one of the supply fan or the heater, an error code through an output unit; and stopping operation of the heater and the supply fan.

9. The method of claim 8, further comprising:

stopping, based on determining the failure of at least one of the supply fan or the heater, the operation of the heater and the supply fan; and heating washing water received in a sump disposed below the tub and supplying steam to the tub.

* * * * *